US007502039B2

(12) United States Patent
Koyama et al.

(10) Patent No.: US 7,502,039 B2
(45) Date of Patent: Mar. 10, 2009

(54) DISPLAY DEVICE AND DRIVING METHOD OF THE SAME

(75) Inventors: Jun Koyama, Kanagawa (JP); Hajime Kimura, Kanagawa (JP); Yu Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 258 days.

(21) Appl. No.: 10/705,827

(22) Filed: Nov. 13, 2003

(65) Prior Publication Data

US 2004/0095364 A1 May 20, 2004

(30) Foreign Application Priority Data

Nov. 14, 2002 (JP) ..... 2002-331331
Nov. 14, 2002 (JP) ..... 2002-331344

(51) Int. Cl.
*G09G 5/10* (2006.01)

(52) U.S. Cl. ..... 345/690; 345/691; 345/692

(58) Field of Classification Search ..... 345/60–104, 345/204, 208–210, 690–692; 315/169.3, 315/169.4; 348/797–799, 800–803
See application file for complete search history.

(56) References Cited

U.S. PATENT DOCUMENTS 5,390,293 A * 2/1995 Nishioka et al. ..... 345/593
5,818,419 A 10/1998 Tajima et al.
5,990,629 A * 11/1999 Yamada et al. ..... 315/169.3
6,037,917 A * 3/2000 Kawakami ..... 345/63
6,040,812 A 3/2000 Lewis
6,084,561 A * 7/2000 Kudo et al. ..... 345/89
6,088,012 A * 7/2000 Shigeta et al. ..... 345/63
6,229,505 B1 5/2001 Fujii
6,339,422 B1 * 1/2002 Kuwajima et al. ..... 345/204

(Continued)

FOREIGN PATENT DOCUMENTS

EP 1 103 946 A2 5/2001

(Continued)

OTHER PUBLICATIONS

Hajime Washio et al.; "TFT-LCDs with Monolithic Multi-Drivers for High Performance Video and Low-Power Text Modes"; *SID 01 Digest*; pp. 276-279; (2001).

(Continued)

*Primary Examiner*—Prabodh Dharia
(74) *Attorney, Agent, or Firm*—Fish & Richardson P.C.

(57) ABSTRACT

Writing of a digital video signal of a lower order bit into a memory is eliminated during a second display mode in which the number of gradations is reduced as compared to in a first display mode of high-level gradation. In addition, read out of the digital video signal of the lower order bit from the memory is also eliminated. The amount of information of a digital image signal inputted to a source signal line driver circuit is reduced. In accordance with such operation, a display controller functions to make start pulses and clock pulses inputted to the source signal line driver circuit have a lower frequency and to lower a driving voltage. When the gradation is reduced, a frame period in the second display mode may be set longer as compared to that in the first display mode, and therefore low electric power consumption is achieved.

42 Claims, 19 Drawing Sheets

U.S. PATENT DOCUMENTS

| | | | | |
|---|---|---|---|---|
| 6,380,689 | B1 * | 4/2002 | Okuda | 315/169.3 |
| 6,396,508 | B1 | 5/2002 | Noecker | |
| 6,417,824 | B1 | 7/2002 | Tokunaga et al. | |
| 6,552,736 | B2 | 4/2003 | Honda et al. | |
| 6,646,625 | B1 * | 11/2003 | Shigeta et al. | 345/63 |
| 6,678,834 | B1 | 1/2004 | Aihara et al. | |
| 6,693,614 | B2 * | 2/2004 | Kamiya et al. | 345/89 |
| 6,738,036 | B2 | 5/2004 | Janssen et al. | |
| 6,806,859 | B1 | 10/2004 | Kanoh et al. | |
| 6,847,339 | B2 * | 1/2005 | Haginoya | 345/60 |
| 7,027,074 | B2 | 4/2006 | Koyama | |
| 2001/0005196 | A1 | 6/2001 | Ishii | |
| 2001/0011989 | A1 | 8/2001 | Hayashi | |
| 2002/0000969 | A1 | 1/2002 | Ozawa | |
| 2002/0041278 | A1 * | 4/2002 | Matsueda | 345/204 |
| 2002/0047568 | A1 | 4/2002 | Koyama | |
| 2002/0047852 | A1 | 4/2002 | Inukai et al. | |
| 2002/0154151 | A1 * | 10/2002 | Koyama | 345/690 |
| 2003/0011626 | A1 * | 1/2003 | Tanabe et al. | 345/690 |
| 2003/0063077 | A1 | 4/2003 | Koyama | |
| 2003/0112257 | A1 * | 6/2003 | Tamura | 345/690 |
| 2003/0174153 | A1 | 9/2003 | Koyama | |
| 2004/0095364 | A1 | 5/2004 | Koyama et al. | |
| 2004/0140972 | A1 * | 7/2004 | Hirota et al. | 345/204 |

FOREIGN PATENT DOCUMENTS

| | | |
|---|---|---|
| EP | 1 184 833 A2 | 3/2002 |
| EP | 1 251 481 | 10/2002 |
| GB | 2177829 | 1/1987 |
| JP | 08-069690 | 3/1996 |
| JP | 11-133921 | 5/1999 |
| JP | 2001-343933 | 12/2001 |
| JP | 2002-108285 | 4/2002 |
| JP | 2002-149113 | 5/2002 |
| TW | 78107405 | 1/1991 |

OTHER PUBLICATIONS

U.S. Appl. No. 11/276,212 filed Feb. 17. 2006; (69 pages).
First Office Action, Chinese Patent Office (Application No. 200310116579.X; CN6730/6731 dated Jan. 19, 2007), 11 pages.

* cited by examiner

Prior Art

Prior Art

Prior Art

Prior Art

DISPLAY DEVICE AND DRIVING METHOD OF THE SAME

BACKGROUND OF THE INVENTION

1. Field of the Invention

The present invention relates to a display device for displaying an image by inputting a digital video signal, and more particularly, such a display device having light emitting elements. Further, the present invention relates to electronic equipment that uses the display device.

2. Description of the Related Art

Hereinafter explained is a display device, which disposes a light emitting element at each pixel and displays an image by controlling the emission of them.

In the explanation throughout this specification, as light emitting elements used are elements (OLED elements) having a structure in which an organic compound layer, that emits light when an electric field is generated, is sandwiched between an anode and a cathode. However, the light emitting element of the present invention is not limited to this structure. Any element which emits light by impressing electric field between the anode and the cathode can freely be used.

A display device is constituted by a display and peripheral circuits for inputting signals to the display.

A structure of a display is shown in a block diagram of FIG. 17. In FIG. 17, a display 1700 is constituted by a source signal line driver circuit 1701, a gate signal line driver circuit 1702, and a pixel portion 1703. The pixel portion has pixels disposed in a matrix shape.

Thin film transistors (hereinafter referred to as TFTs) are arranged in each pixel of the pixel portion. Explanation is herein made on a method of placing two TFTs in each pixel and controlling light emitted from the light emitting element of each pixel.

FIG. 7 shows a structure of a pixel portion of a display. Source signal lines S1 to Sx, gate signal lines G1 to Gy, and power supply lines V1 to Vx are arranged in a pixel portion 700, and x columns and y rows (where x and y are natural numbers) of pixels are also placed in the pixel portion. Each pixel 800 has a switching TFT 801, a driver TFT 802, a storage capacitor 803, and a light emitting element 804.

A pixel of the pixel portion shown in FIG. 7 is shown magnified in FIG. 8. The pixel is constituted by one source signal line S of the source signal lines S1 to Sx, one gate signal line G of the gate signal lines G1 to Gy, one power supply line V of the power supply lines V1 to Vx, the switching TFT 801, the driver TFT 802, the storage capacitor 803, and the light emitting element 804.

A gate electrode of the switching TFT 801 is connected to the gate signal line G, and either a source region or a drain region of the switching TFT 801 is connected to the source signal line S, while the other is connected to a gate electrode of the driver TFT 802 and to one electrode of the storage capacitor 803. Either a source region or a drain region of the driver TFT 802 is connected to the power supply line V, while the other is connected to an anode or a cathode of the light emitting element 804. The power supply line V is connected to one of the two electrodes of the storage capacitor 803, namely the electrode on a side to which the driver TFT 802 and the switching TFT 801 are not connected.

The anode of the light emitting element 804 is referred to as a pixel electrode, and the cathode of the light emitting element 804 is referred to as an opposing electrode, within this specification for cases in which the source region or the drain region of the driver TFT 802 is connected to the anode of the light emitting element 804. On the other hand, if the source region or the drain region of the driver TFT 802 is connected to the cathode of the light emitting element 804, then the cathode of the light emitting element 804 is referred to as the pixel electrode, and the anode of the light emitting element 804 is referred to as the opposing electrode.

Further, a potential imparted to the power supply line V is referred to as a power source potential, and a potential imparted to the opposing electrode is referred to as an opposing potential.

The switching TFT 801 and the driver TFT 802 may be either p-channel TFTs or n-channel TFTs.

The storage capacitor 803 is not necessarily provided.

For instance, when an n-channel TFT used for the driver TFT 802 has an LDD region formed so as to overlap the gate electrode with a gate insulating film interposed, a parasitic capacitance called in general a gate capacitance is formed in this overlapping area. The parasitic capacitance may be used positively for a storage capacitor to store the voltage supplied to the gate electrode of the driver TFT 802.

Operations during display of an image with the aforementioned pixel structure are explained below.

A signal is inputted to the gate signal line G, and the potential of the gate electrode of the switching TFT 801 changes, then a gate voltage is changed. The signal is inputted to the gate electrode of the driver TFT 802 from the source signal line S, via source and drain of the switching TFT 801 which thus has been in a conductive state. Further, the signal is stored in the storage capacitor 803. The gate voltage of the driver TFT 802 changes in accordance with the signal inputted to the gate electrode of the driver TFT 802, then the source and drain are in a conductive state. The potential of the power supply line V is imparted to the pixel electrode of the light emitting element 804 through the driver TFT 802. The light emitting element 804 thus emits light.

A method of expressing gradations with pixels having such a structure is explained.

Gradation expression methods can be roughly divided into an analog method and a digital method. The digital method has advantages of being good at variation of TFTs and increasing gradations.

A time gradation method is known as an example of the digital gradation expression method. The time gradation driving method is a method of expressing gradations by controlling the period that each pixel of a display device emits light. (See a patent document 1)

If a period for displaying one image is taken as one frame period, then one frame period is divided into a plurality of subframe periods.

Turn on or turn off, namely whether the light emitting element of each pixel is made to emit light or not, is performed for each subframe period. Then, the period during which the light emitting element emits light in one frame period is controlled to express a gradation for each pixel.

The time gradation driving method is explained in detail using timing charts of FIG. 5. Note that an example of expressing gradation using a 4-bits digital image signal is shown in FIG. 5. Note also that FIG. 7 and FIG. 8 may be referred to regarding the structure of the pixels and the pixel portion. With an external power source (not shown in the figure), the opposing potential can be switched between a potential which is nearly the same as that of the power supply lines V1 to Vx (power source potential), and a potential which has a difference from the power supply lines V1 to Vx to an extent that the light emitting element 804 will emit light.

In FIG. 5A, one frame period F1 is divided into a plurality of subframe periods SF1 to SF4.

The gate signal line G1 is selected first in the first subframe period SF1, and a digital image signal is inputted from the source signal lines S1 to Sx to each of the pixels having the switching TFTs 801 with gate electrodes connected to the gate signal line G1. The driver TFT 802 of each pixel is placed in an ON state or an OFF state by the inputted digital image signal.

The term "ON state" for a TFT in this specification indicates that there is a conductive state between the source and the drain in accordance with the gate voltage. Further, the term "OFF state" for a TFT indicates that there is a non-conductive state between the source and the drain in accordance with the gate voltage.

The opposing potential of the light emitting elements 804 is herein set nearly equal to the potential of the power supply lines V1 to Vx (power source potential), and therefore the light emitting elements 804 do not emit light even in pixels having their driver TFT 802 in an ON state.

FIG. 5B is a timing chart which shows an operation for inputting digital image signals to the driver TFTs 802 of each pixel.

In FIG. 5B, S1 to Sx indicate the period in which a signal corresponding to each source signal line is sampled in a source signal line driver circuit (not shown in the figure). The signals sampled are simultaneously outputted to each source signal line during a fly-back period shown in the figure. The outputted signal is inputted to the gate electrode of the driver TFT 802 in a pixel selected by the gate signal line.

The aforementioned operations are repeated for all of the gate signal lines G1 to Gy, and a write-in period Ta1 is completed. Note that a period for write-in during the first subframe period SF1 is called Ta1. In general, a write-in period of the j-th subframe period (where j is a natural number) is called Taj.

The opposing potential changes when the write-in period Ta1 is completed, so as to have a potential difference from the power source potential to an extent that the light emitting element 804 will emit light. A display period Ts1 thus begins. Note that the display period of the first subframe period SF1 is called Ts1. In general, a display period of the j-th subframe period (where j is a natural number) is called Tsj. The light emitting element 804 of each pixel are placed in a light emitting state or a non-light emitting state, corresponding to the inputted signal, in the display period Ts1.

The above operations are repeated for all of the subframe periods SF1 to SF4, then, one frame period F1 is completed. The length of the display periods Ts1 to Ts4 of the subframe periods SF1 to SF4 can be set appropriately, and gradations are expressed by an accumulation of the display periods of the subframe period during which the light emitting elements 804 emit light. In other words, the total amount of the turn-on time within one frame period is used to express the gradations.

A method of generally expressing $2^n$ gradations by inputting n-bit digital video signals, is explained. One frame period is divided into n subframe periods SF1 to SFn, for example, and the ratios of the lengths of the display periods Ts1 to Tsn of the subframe periods SF1 to SFn are set so as to be Ts1:Ts2: . . . :Tsn-1:Tsn=$2^0$:$2^{-1}$: . . . : $2^{-n+2}$:$2^{-n+1}$. Note that the lengths of the write-in periods Ta1 to Tan are all the same.

The gradation of the pixels in one frame period is determined by finding the total of the display period Ts during which a light emitting state is selected in the light emitting element 804. When n=8, for example, if the brightness for a case in which a pixel emits light during all of the display periods is taken to be 100%, a brightness of 1% can be expressed when the pixel emits light in the display periods Ts8 and Ts7. A brightness of 60% can be expressed when the pixel emits light in the display periods Ts6, Ts4, and Ts1.

Incidentally, a subframe period can be further divided into a plurality of subframe periods.

It is preferable that the display device has as little electric power consumption as possible here. Low electric power consumption is especially desirable if the display device is incorporated into a portable information device or the like to be utilized.

In this case, with respect to a display device, into which the 4 bit signal mentioned above is inputted to thereby display $2^4$ gradations, a method of expressing gradations by using only the high 1-bit signal is used in order to reduce the electric power consumption of the display device. (See a patent document 2)

[Patent Document 1]

Japanese Patent Application Laid-open No. 2001-343933

[Patent Document 2]

Japanese Patent Application Laid-open No. Hei 11-133921

A timing chart showing a driving method of the display device in a first display mode of expressing $2^4$ gradations is shown in FIG. 13A, and another timing chart showing a driving method of the display device in a second display mode of expressing gradations by using only the high 1-bit signal is shown in FIG. 13B.

One subframe period is sufficient for the driving method in the second display mode. Therefore, it is possible to make start pulses and clock pulses inputted to each driver circuit (source signal line driver circuit and gate signal line driver circuit) have a lower frequency, and to realize lower electric power consumption as compared with the driving method in the first display mode of expressing gradations of the high 1-bit.

When the accumulated length of write-in periods of the first display mode is longer than that of the second display mode, the proportion that an effective display period occupies per one frame period is increased by changing the voltage between a cathode and an anode of a light emitting element according to the display period.

However, the voltage inputted to each driver circuit is equal for both first and second display modes in such a display device, and it may not lead to lower electric power consumption.

An object of the present invention is to provide a display device in which electric power consumption is smaller, when performing drive in which the number of gradations expressed is reduced.

SUMMARY OF THE INVENTION

A display device of the present invention has a first display mode capable of expressing high-level gradations and a second display mode capable of expressing two gradations with low electric power consumption, and these 2 modes can be switched mutually and used. Writing of the low bits of a digital video signal to a memory is eliminated by a memory controller of a signal control circuit in the display device during the second display mode as compared to the first display mode. Further, reading out of the low bits of the digital video signal from the memory is also eliminated. Each driver circuit thus inputs to a source signal line driver circuit a digital image signal with a reduced amount of information (a second digital image signal) to a source signal line driver circuit in comparison to a digital image signal in the first display mode (a first digital image signal). Corresponding to this operation, a display controller functions to produce start pulses and clock pulses each with a lower frequency which are inputted to each of the driver circuits (the source signal line driver circuit and a gate signal line driver circuit), and to lower a driving voltage. Write-in periods and display periods participating in display can thus be set longer to reduce the electric power consumption.

Note that, in the case of using a monochrome display device as the display device, a two-color display using white and black is referred to as a two-gradation display. In the case of using a color display device as the display device, a eight-color display is referred to as the two-gradation display.

Further, one frame period per se can be set longer in the second display mode in comparison to that in the first display mode. And, needless to say that the start pulses and clock pulses can be stopped when the contents of display are defined and there is no necessary to write.

In driving the display device in the second display mode, the voltage for driving the display controller may be set lower to reduce the electric power consumption of the display controller.

In the second display mode, a display device in which the electric power consumption is small and in which the proportion that an effective display period occupies is large, can thus be provided in accordance with the above structure.

A display device of the present invention comprises:

a display;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means not for dividing one frame period into a plurality of subframe periods, for setting one of lighting and non-lighting to the one frame period, for expressing 1-bit gradation in accordance with a total lighting time during the one frame period, and for operating the display with a lower clock frequency and a lower driving voltage than the first means, wherein the first and second means are controlled by the display controller.

A display device of the present invention comprises:

a display;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means not for dividing one frame period into a plurality of subframe periods, for setting one of lighting and non-lighting to the one frame period, for expressing 1-bit gradation in accordance with a total lighting time during the one frame period, for having a longer frame period as compared with the first display mode, and for operating the display with a lower clock frequency and a lower driving voltage than the first means, wherein the first and second means are controlled by the display controller.

A display device of the present invention comprises a frame memory, wherein n-bits data (n is a natural number of two or more) is written and read out to perform a display operation in the first means; and 1-bit data is written and read out to perform a display operation in the second means.

A display device of the present invention comprises a light emitting element for each pixel, wherein a specific voltage is applied to the light emitting element; and a voltage applied to the light emitting element in the first means is higher than a voltage applied to the light emitting element in the second means.

A display device of the present invention comprises a light emitting element for each pixel, wherein a specific current is supplied to the light emitting element; and a current supplied to the light emitting element in the first means is larger than a current supplied to the light emitting element in the second means.

In a display device of the present invention, the one frame period is composed of three periods of a write-in period, a display period, and an erasing period in the first means.

In a display device of the present invention, the display controller operates at a lower voltage in the second means as compared with in the first means.

A driving method of the display device according to the present invention comprises:

a display;

a display controller;

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode not for dividing one frame period into a plurality of subframe periods, for setting one of lighting and non-lighting to the one frame period, for expressing 1-bit gradation in accordance with a total lighting time during the one frame period, and for operating the display at a lower clock frequency and a lower driving voltage than the first display mode, wherein the first and second display modes are controlled by the display controller.

A driving method of a display device according to the present invention comprises:

a display;

a display controller;

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode not for dividing one frame period into a plurality of subframe periods, for setting one of lighting and non-lighting to the one frame period, for expressing 1-bit gradation in accordance with a total lighting time during the one frame period, for having a longer frame period as compared with the first display mode, and for operating the display at a lower clock frequency and a lower driving voltage than the first display mode, wherein the first and second display modes are controlled by the display controller.

In a driving method of a display device according to the present invention, the display device comprises a frame memory, n-bits data (n is a natural number of two or more) is written and read out in the first display mode, and 1-bit data is written and read out in the second display mode.

In a driving method of a display device according to the present invention, the display device comprises a light emitting element for each pixel, a specific voltage is applied to the light emitting element, and a voltage applied to the light emitting element in the first display mode is higher than a voltage applied to the light emitting element in the second display mode.

In a driving method of a display device according to the present invention, the display device comprises a light emitting element for each pixel, a specific current is supplied to the light emitting element, and a current supplied to the light emitting element in the first display mode is larger than a current supplied to the light emitting element in the second display mode.

In a driving method of a display device according to the present invention, the first display mode is composed of three periods of a write-in period, a display period, and an erasing period.

In a driving method of a display device according to the present invention, the display controller operates at a lower voltage in the second display mode as compared with in the first display mode.

In a display device and a driving method thereof according to the present invention, the display device or the driving method of the display device is applied to electronic equipment.

A display device of the present invention has a first display mode capable of expressing high-level gradations and a second display mode capable of expressing low-level gradations with low electric power consumption, and these 2 modes can be switched mutually and used. Writing of the low bits of a digital video signal to a memory is eliminated by a memory controller of a signal control circuit in the display device during the second display mode as compared to the first display mode. Further, reading out of the low bits of the digital signal from the memory is also eliminated. Each driver circuit thus inputs a digital image signal with a reduced amount of information to a source signal line driver circuit in comparison to a digital image signal in the first display mode. Corresponding to this operation, a display controller functions to make start pulses and clock pulses inputted to each of the driver circuits (source signal line driver circuit and gate signal line driver circuit) have a lower frequency, and to lower a driving voltage. Write-in periods and display periods participating in display can thus be set longer to reduce the electric power consumption.

In driving the display device in the second display mode, a voltage for driving the display controller may be set lower to reduce the electric power consumption of display controller.

In the second display mode, a display device in which the electric power consumption is small and in which the proportion that an effective display period occupies is large, and a driving method thereof can thus be provided in accordance with the above structure.

A display device of the present invention comprises:

a display;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means for dividing one frame period into a plurality of subframe periods and setting one of lighting and non-lighting to each of the plurality of subframe periods, for expressing m-bits gradation (m is a natural number less than n) in accordance with a total lighting time during the one frame period, and for operating the display at a lower clock frequency and a lower driving voltage than the first means, wherein the first and second means are controlled by the display controller.

A display device of the present invention comprises a frame memory, wherein n-bits data (n is a natural number of two or more) is written and read out to perform a display operation in the first means; and m-bits data (m is a natural number less than n) is written and read out to perform a display operation in the second means.

A display device of the present invention comprises a light emitting element for each pixel, wherein a specific voltage is applied to the light emitting element; and a voltage applied to the light emitting element in the first means is higher than a voltage applied to the light emitting element in the second means.

A display device of the present invention comprises a light emitting element for each pixel, wherein a specific current is supplied to the light emitting element; and a current supplied to the light emitting element in the first means is larger than a current supplied to the light emitting element in the second means.

In a display device of the present invention, the one frame period is composed of three periods of a write-in period, a display period, and an erasing period in the first display mode.

In a display device of the present invention, the one frame period is composed of three periods of a write-in period, a display period, and an erasing period in the second means.

In a display device of the present invention, the display controller operates at a lower voltage in the second means as compared with in the first means.

In a driving method of a display device according to the present invention, the display device comprises a display and a display controller, and the driving method comprises:

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode for dividing one frame period into a plurality of subframe periods and setting one of lighting and non-lighting to each of the plurality of subframe periods, for expressing m-bits gradation (m is a natural number less than n) in accordance with a total lighting time during the one frame period, and for operating the display at a lower clock frequency and a lower driving voltage than the first display mode, wherein the first and second display modes are controlled by the display controller.

In a driving method of a display device according to the present invention, the display device comprises a frame memory, n-bits data (n is a natural number of two or more) is written and read out to perform a display operation in the first display mode, and 1-bit data is written and read out to perform a display operation in the second display mode.

In a driving method of a display device according to the present invention, the display device comprises a light emitting element for each pixel, a specific voltage is applied to the light emitting element, and a voltage applied to the light emitting element in the first display mode is higher than a voltage applied to the light emitting element in the second display mode.

In a driving method of a display device according to the present invention, the display device comprises a light emitting element for each pixel, a specific current is supplied to the light emitting element, and a current supplied to the light emitting element in the first display mode is larger than a current supplied to the light emitting element in the second display mode.

In a driving method of a display device according to the present invention, the first display mode is composed of three periods of a write-in period, a display period, and an erasing period.

In a driving method of a display device according to the present invention, the second display mode is composed of three periods of a write-in period, a display period, and an erasing period.

In a driving method of a display device according to the present invention, the display controller operates at a lower voltage in the second display mode as compared with in the first display mode.

In a display device and a driving method thereof according to the present invention, the display device or the driving method thereof is applied to electronic equipment.

DETAILED DESCRIPTION OF THE PREFERRED EMBODIMENTS

Embodiment Mode 1

Embodiment mode 1 of the present invention is explained. Here, similarly to the conventional examples, an example of the first display mode will be described with 4-bits.

Figure 1A:
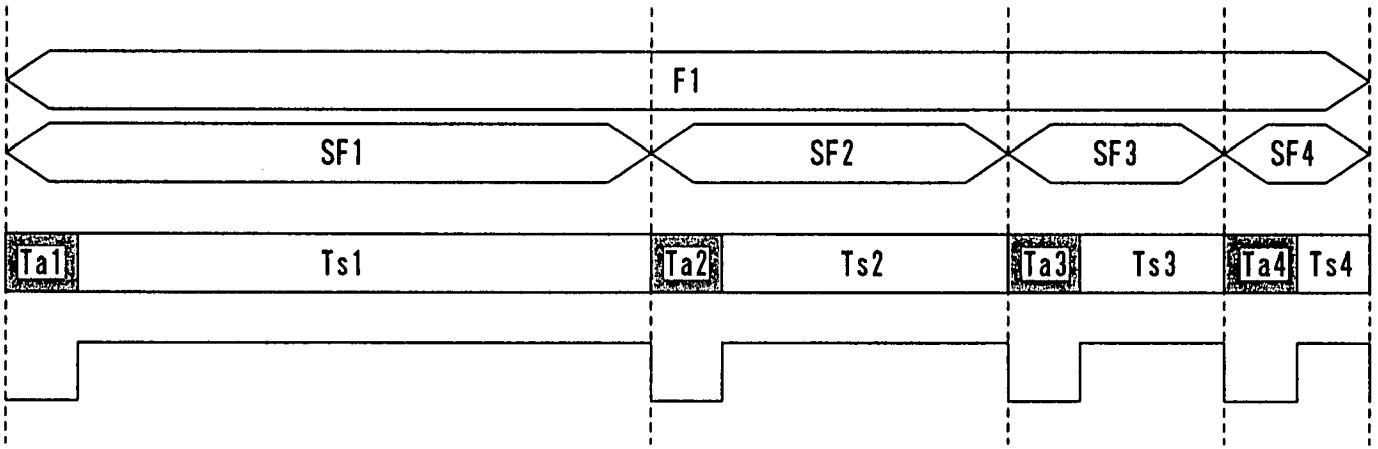
FIGS. 1A and 1B are diagrams showing timing charts for a method of driving a display device of the present invention.
Figure 1B:
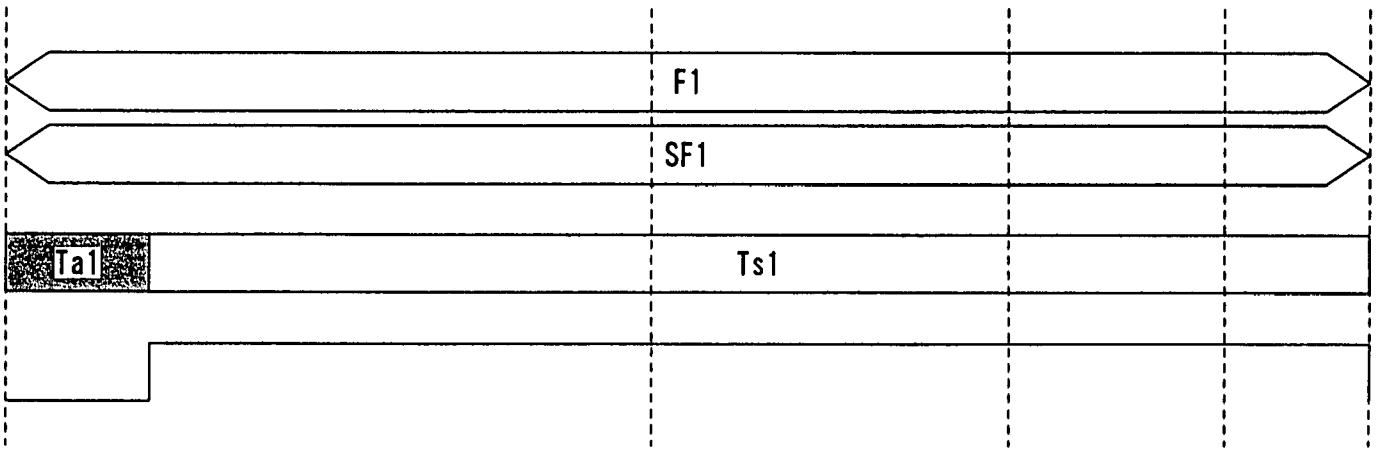

Timing charts for a method of driving a display device of the present invention are shown in FIGS. 1A and 1B. Generally, in a display device into which an n-bits digital video signal (n is a natural number) is inputted, it is possible to express $2^n$ gradations by using the n-bits digital image signal and n subframe periods SF1 to SFn in the first display mode. On the other hand, 2 gradations are expressed by using 1-bit digital image signal in the second display mode in accordance with switch-over operation. The present invention can also be applied to such a case.

Furthermore, in a display device into which an n-bits digital video signal (n is a natural number) is inputted, it is possible to express n gradations by using the n-bits digital image signal and at least n subframe periods in the first display mode. On the other hand, 2 gradations are expressed by using 1-bit digital image signal in the second display mode in accordance with switch-over operation. The present invention can also be applied to such a case. Here the reason why the number of gradations is not set to a power of two of subframes is to take a measure for a pseudo contour on display. Details are described in Japanese Patent Application No. 2001-257163.

A timing chart in a case of the first display mode, in which the 4-bits signal is inputted and $2^4$ gradations are expressed, is shown in FIG. 1A.

Each pixel is selected to be in a light emitting state or in a non-light emitting state in a display period in each of subframe periods SF1 to SF4 structuring one frame period. An opposing potential is set to be nearly the same as a power source potential during write-in periods, and is changed in the display periods so as to have a potential difference from the power source potential to an extent that light emitting elements will emit light. These operations are similar to the conventional example, and a detailed explanation is therefore omitted.

A timing chart in a case of the second display mode for expressing gradations using only the high 1-bit signal is shown in FIG. 1B. Compared to the subframe period corresponding to the high bit in the first display mode shown in FIG. 1A, the write-in period and the display period are set longer.

Therefore, in the second display mode, the brightness of the light emitting element selected to be in a light emitting state can be made smaller as compared to the brightness of the light emitting element selected to be in a light emitting state in the display period of the subframe period corresponding to the high bit in the first display mode. Consequently, the voltage applied between an anode and a cathode of the light emitting element can be set lower in the display period with the second display mode.

Figure 19A:
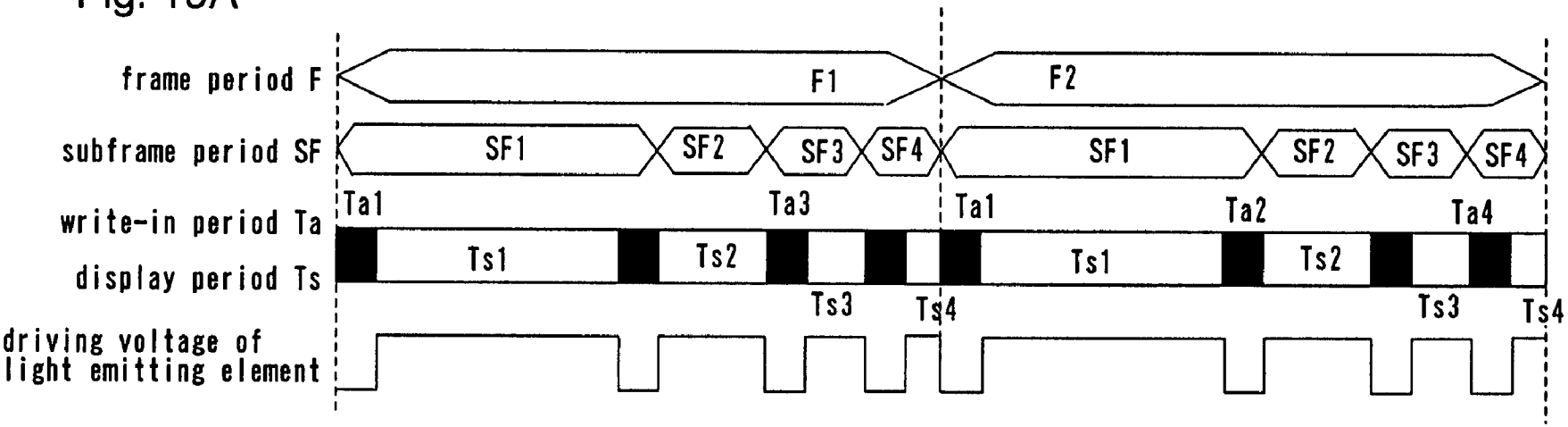
FIGS. 19A and 19B are diagrams showing timing charts for a method of driving the display device of the present invention.
Figure 19B:
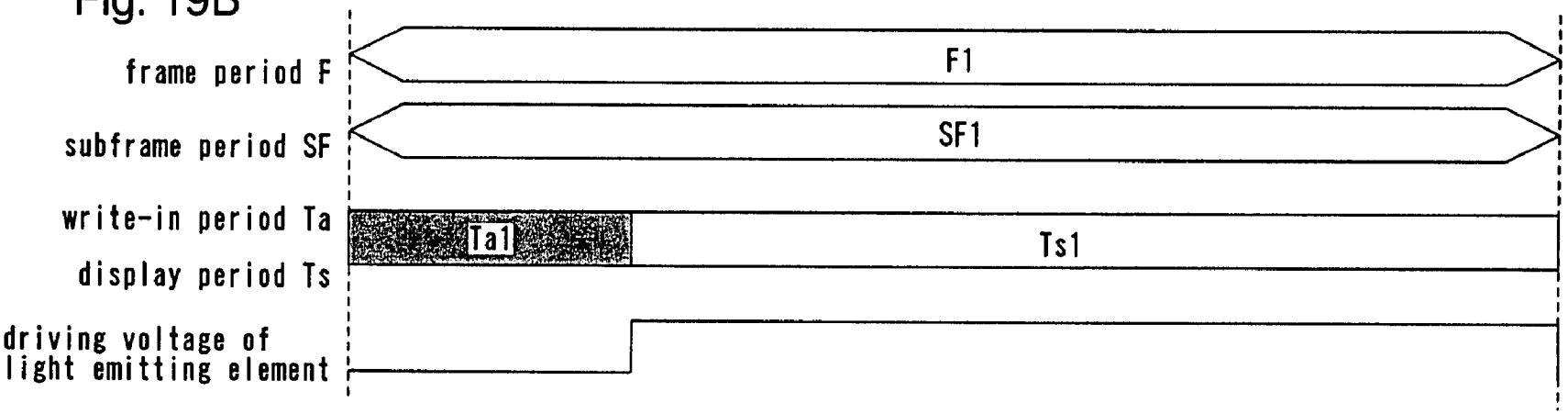

Furthermore, FIGS. 19A and 19B show an example in which the frame period of the second display mode is set to be longer than that of the first display mode. A long frame period is impossible to be set when a time gradation is used. If the frame period is set longer, the subframe period in proportion thereto will also become longer, flickers will thus be recognized. Accordingly, the frame period of the first display mode cannot be set longer. However, since the second display mode is 2 gradations, problems of flickers caused by the gradation will not occur. Accordingly, the frame period is determined by a retention time in the pixel. Therefore, the frame period can be set longer by enlarging capacities of pixel, reducing leaks and the like. When the frame period becomes longer, since the number of write-in periods to the screen can be reduced, thus, low electric power consumption can be achieved.

Figure 3:
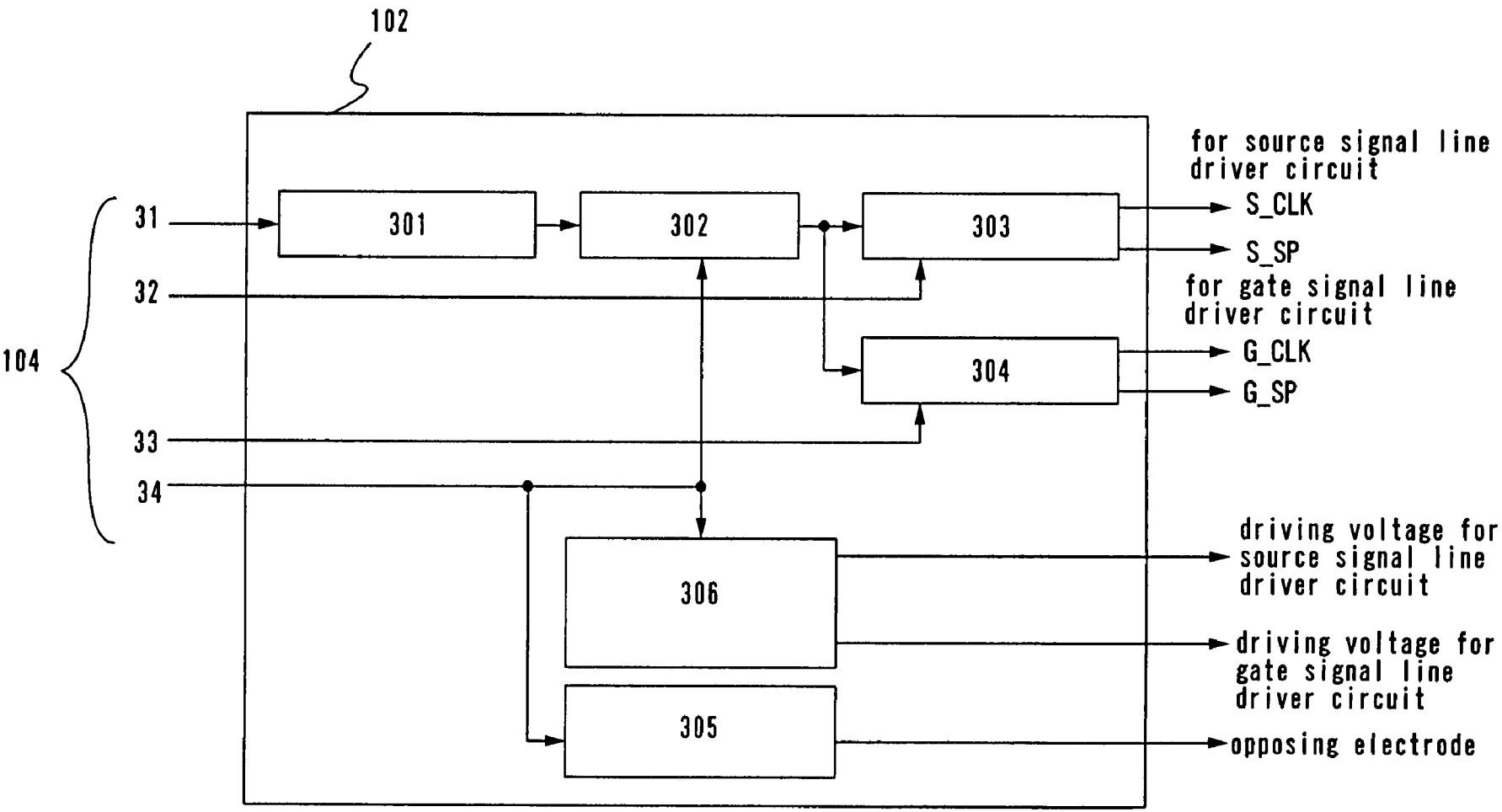
FIG. 3 is a diagram showing a structure of a display controller of the display device of the present invention.

A structure of a display controller is shown in FIG. 3. During the write-in period, a power source control circuit for the light emitting element 305 in FIG. 3 maintains the potential of the opposing electrode (opposing potential) of the light emitting element at a potential which is nearly the same as the power source potential. In the display period, the potential of the opposing electrode of the light emitting element is controlled so as to have a potential difference from the power source potential to an extent that the light emitting element will emit light. When the second display mode is selected, a gradation control signal 34 is inputted to the power source control circuit for the light emitting element 305 here. The potential of the opposing electrode of the light emitting element is thus changed in order that the voltage applied between both the electrodes of the light emitting element becomes smaller by an amount that the light emitting period for the light emitting element becomes longer in a pixel selected to be in a light emitting state.

Since the voltage applied between both the electrodes of the light emitting element can be made smaller in the second display mode, stress on the light emitting element due to the applied voltage can also be made smaller.

A power source control circuit for the driver circuit 306 controls the power source voltage inputted to each driver circuit. When the second display mode is selected here, the gradation control signal 34 is inputted to the power source control circuit for the driver circuit 306 to change the outputted power source voltage used for a source signal line driver circuit and the outputted driving voltage used for a gate signal line driver circuit. Compared to in the first display mode, clock pulses of each driver circuit have a lower frequency in the second display mode, and therefore each driving voltage can be operated at a lower power source voltage.

Note that although the display device shown is one which switches between the first display mode and the second display mode, the present invention can also be applied to a case in which, in addition to the first display mode and the second display mode, at least one more mode in which the number of gradations expressed is changed is additionally established, and display is performed by switching between the plurality of display modes.

Figure 7:
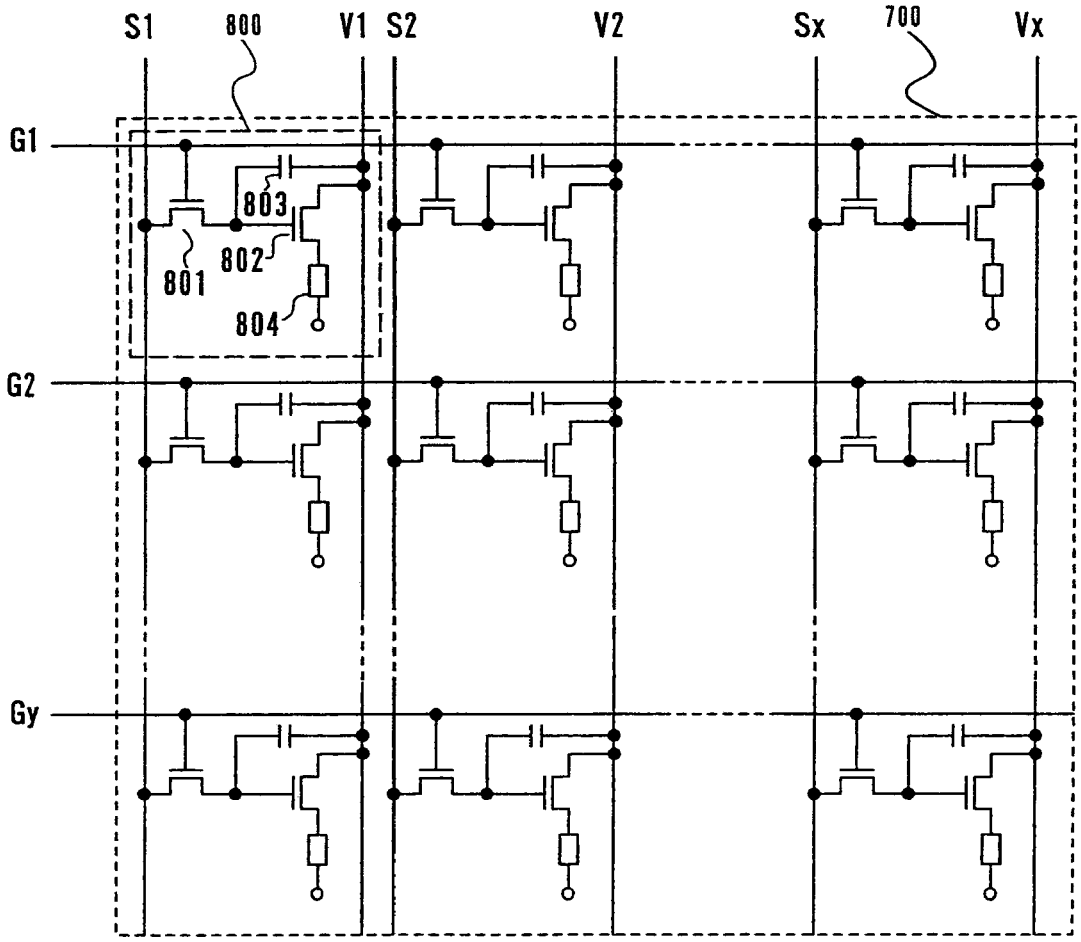
FIG. 7 is a diagram showing a structure of a pixel portion of the display device.

Pixels with the structure shown in FIG. 7 in the conventional example can be used here to structure the pixel portion of the display of the display device according to the present invention. Further, pixels with another known structure can also be freely used.

Furthermore, circuits with known structures can be freely used for the source signal line driver circuit and the gate signal line driver circuit of the display of the display device according to the present invention.

When driving the display device in the second display mode, the voltage to drive the display controller can be set lower to reduce the electric power consumption of the display controller.

In addition, it is also possible to apply the present invention not only to a display device using OLED elements as light emitting elements, but also to self-light emitting type display devices such as field emission displays and plasma displays.

Embodiment Mode 2

Embodiment mode 2 of the present invention is explained. Here, similar to the conventional examples, an example of the first display mode will be described with 4-bits.

Figure 18A:
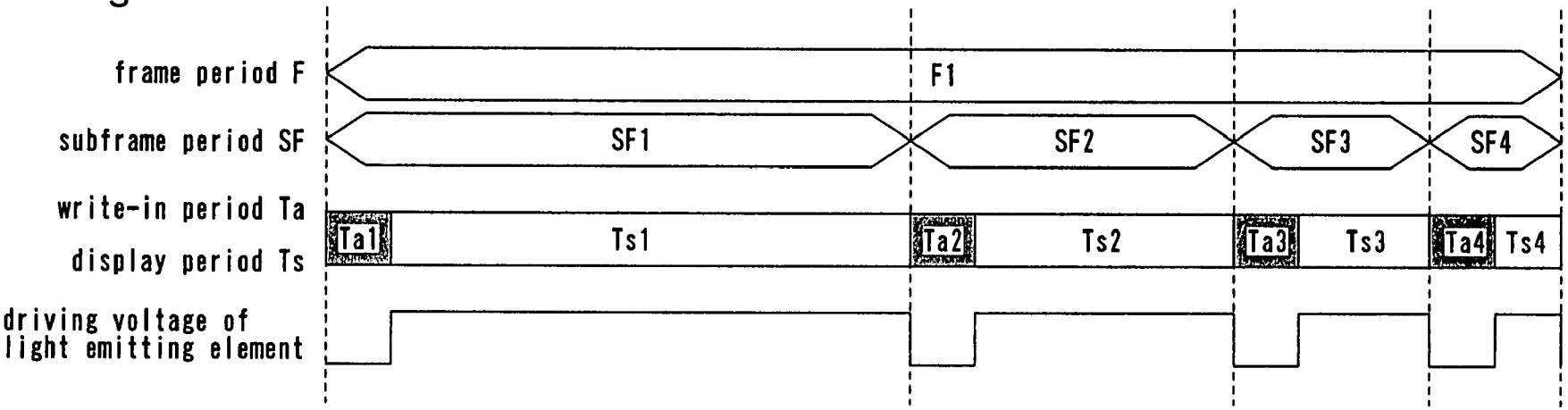
FIGS. 18A and 18B are diagrams showing timing charts for a method of driving the display device of the present invention.
Figure 18B:
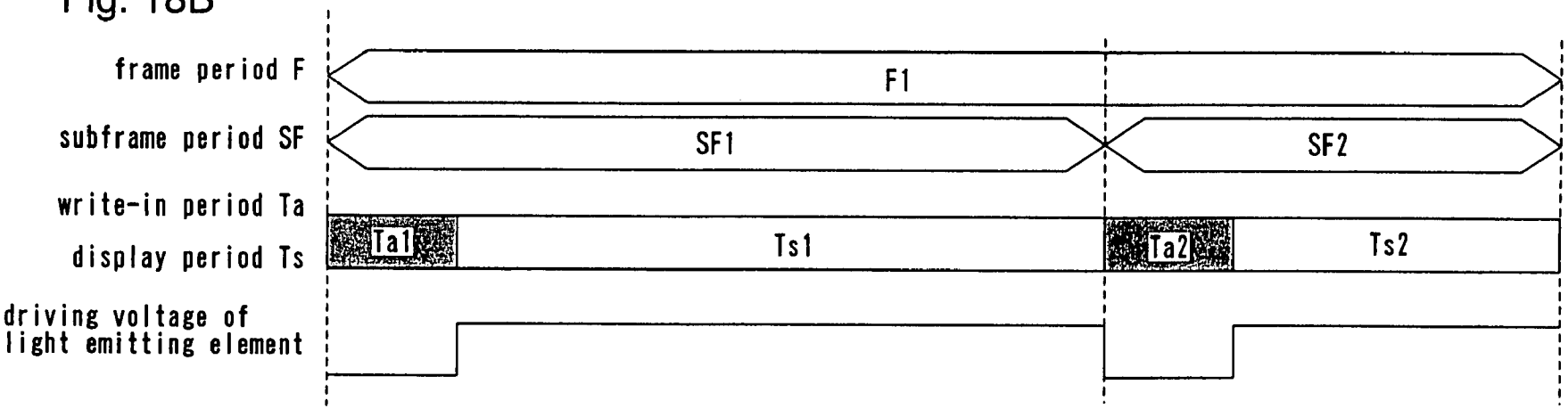

Timing charts for a method of driving a display device of the present invention are shown in FIGS. 18A and 18B. Generally, in a display device into which an n-bits digital video signal (n is a natural number) is inputted, it is possible to express $2^n$ gradations by using the n-bits digital image signal and n subframe periods SF1 to SFn in the first display mode. On the other hand, $2^m$ gradations are expressed by using an m-bits digital image signal (m is a natural number less than n) in the second display mode in accordance with switch-over operation.

Furthermore, in a display device into which an n-bits digital video signal (n is a natural number) is inputted, it is possible to express n gradations by using the n-bits digital image signal and at least n subframe periods in the first display mode. On the other hand, in the second display mode, m gradations are expressed by using an m-bits digital image signal (m is a natural number less than n) and at least m subframe periods in accordance with switch-over operation. Here the reason why the number of gradations is not set to a power of two of subframes is to take a measure for a pseudo contour on display. Details are described in Japanese Patent Application No. 2001-257163.

A timing chart in a case of the first display mode, in which the 4-bits signal is inputted and $2^4$ gradations are expressed, is shown in FIG. 18A.

Each pixel is selected to be in a light emitting state or in a non-light emitting state in a display period in each of subframe periods SF1 to SF4 structuring one frame period. An opposing potential is set to be nearly the same as a power source potential during write-in periods, and is changed in the display periods so as to have a potential difference from the power source potential to an extent that light emitting elements will emit light. These operations are similar to the conventional example, and a detailed explanation is therefore omitted.

A timing chart in a case of the second display mode for expressing gradations using only the high 2-bits signal is shown in FIG. 18B. Compared to the accumulated subframe periods corresponding to the high 2-bits in the first display mode shown in FIG. 18A, the total periods of the write-in periods and the display periods are set longer. Therefore, in the second display mode, the brightness of the light emitting element selected to be in a light emitting state can be made smaller as compared to the brightness of the light emitting element selected to be in a light emitting state in the display period of the subframe period corresponding to the high 2-bits in the first display mode. Consequently, the voltage applied between an anode and a cathode of the light emitting element can be set lower in the display period with the second display mode.

The display controller can be structured with the same structure as described in Embodiment mode 1.

Embodiment

Hereinafter, embodiments of the present invention will be described.

Embodiment 1

Figure 6:
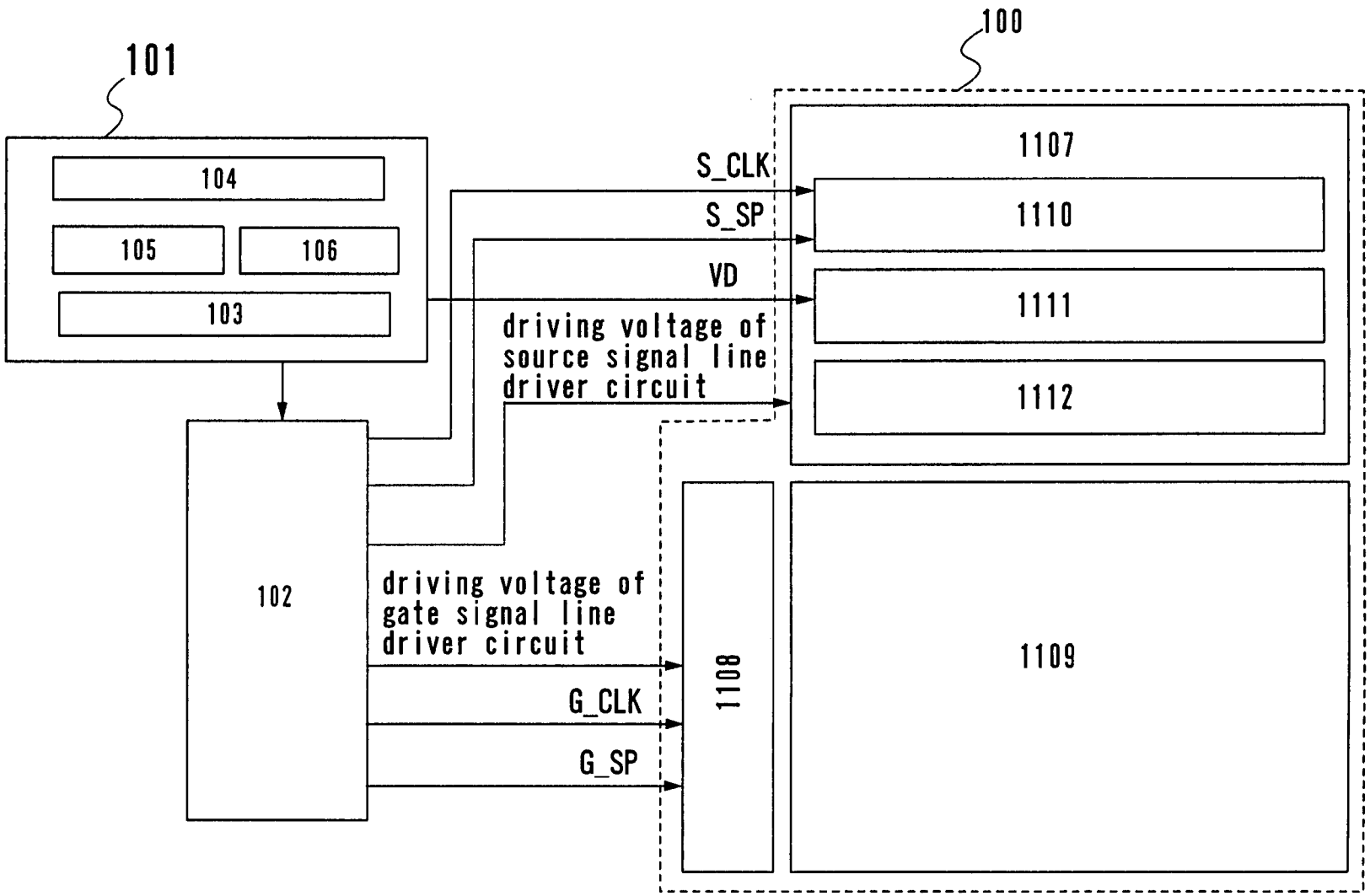
FIG. 6 is a block diagram showing a structure of the display device of the present invention.

With reference to FIG. 6, a circuit for inputting a signal in order to perform a time gradation driving method to the source signal line driver circuit and the gate signal line driver circuit of the display is explained.

Image signals inputted to the display device are referred to as digital video signals within this specification. Note that the example explained here is that of a display device into which a 4-bits digital video signal is inputted. However, the present invention is not limited to 4-bits.

The digital video signal is read in by a signal control circuit 101, and a digital image signal (VD) is outputted to a display 100.

A signal converted for input to the display in the signal control circuit 101, the edited digital video signal, is referred to as a digital image signal within this specification.

Signals and driving voltages for driving a source signal line driver circuit 1107 and a gate signal line driver circuit 1108 of the display 100 are inputted from a display controller 102.

Note that the source signal line driver circuit 1107 of the display 100 is constituted by a shift register 1110, an LAT (A) 1111, and an LAT (B) 1112. In addition, although not shown in the figures, circuits such as level shifters and buffers may also be formed. Further, the present invention is not limited to such a structure.

The signal control circuit 101 is constituted by a CPU 104, a memory A 105, a memory B 106, and a memory controller 103.

The digital video signal inputted to the signal control circuit 101 is inputted to the memory A 105 through the memory controller 103. The memory A 105 has a capacity that is capable of storing the 4-bits digital video signal for all pixels of a pixel portion 1109 of the display 100. When one frame period portion of the signal is stored in the memory A 105, the signal for each bit is read out in order by the memory controller 103, and then is inputted to the source signal line driver circuit as the digital image signal VD.

When readout of the signal stored in the memory A 105 begins, the digital video signal corresponding to the next frame period is then inputted to the memory B 106 through the memory controller 103, and storage of the digital video signal in the memory B 106 begins. Similarly to the memory A 105, the memory B 106 also has a capacity that is capable of storing the 4-bits digital video signal for all pixels of the display device.

The signal control circuit 101 thus has the memory A 105 and the memory B 106, each of which is capable of storing one frame period portion of the 4-bits digital video signal. The digital video signal is sampled by using the memory A 105 and the memory B 106 alternately.

The signal control circuit 101 for storing signals by using the two memories alternately, namely the memory A 105 and the memory B 106, is shown here. In general, however, memories capable of storing information corresponding to a plurality of frame portions are used, and these memories can be used alternately.

Figure 4:
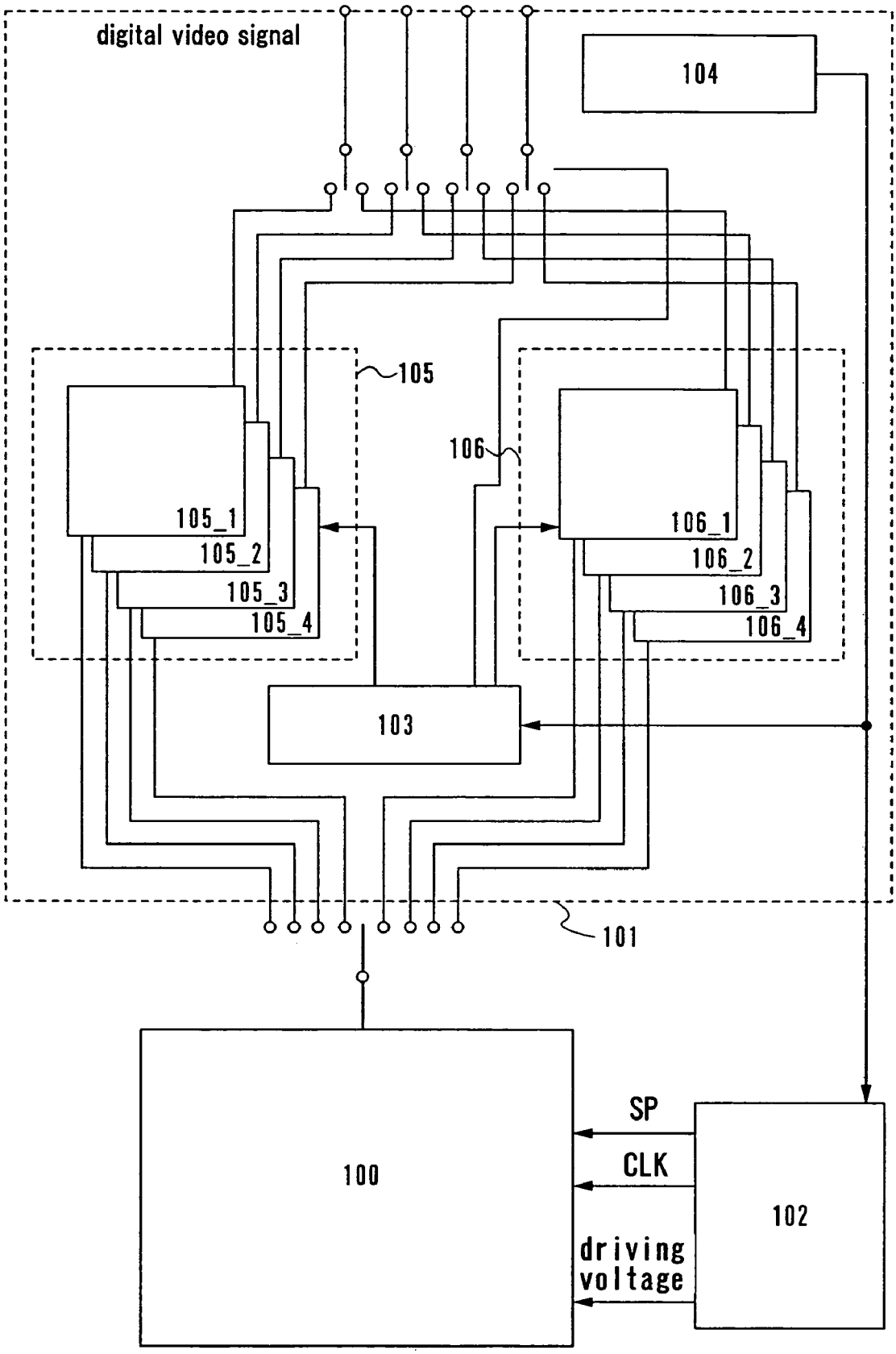
FIG. 4 is a block diagram showing a structure of the display device of the present invention.
Figure 5A:
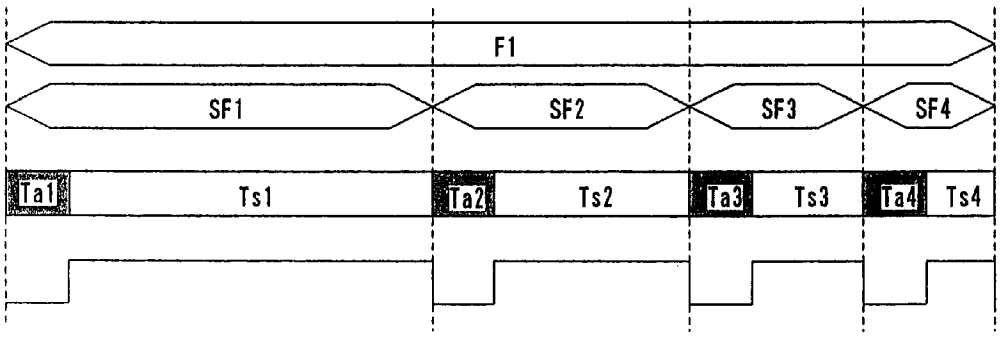
FIGS. 5A and 5B are diagrams showing timing charts for a time gradation driving method.
Figure 5B:
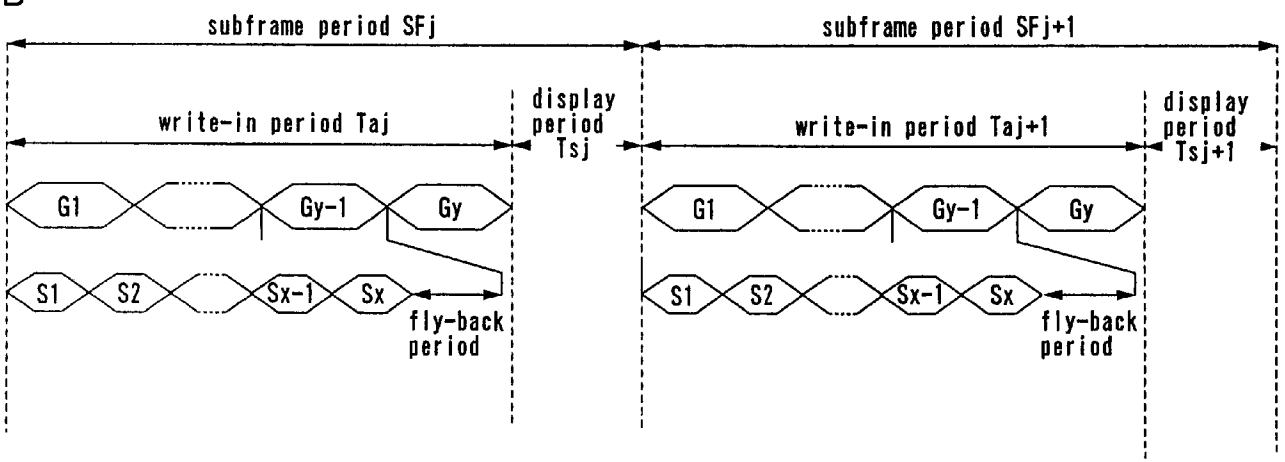
Fig. 5B Prior Art

A block diagram of the display device for performing the above operations is shown in FIG. 4. The display device is constituted by a signal control circuit 101, a display controller 102, and a display 100.

The display controller 102 supplies a start pulse SP, a clock pulse CLK, and a driving voltage to the display 100.

Shown in FIG. 4 is an example of a display device in which the 4-bits digital video signal is inputted, and which expresses gradations using the 4-bits digital image signal in the first display mode. The memory A 105 is constituted by memories 105_1 to 105_4 for storing a first bit to a fourth bit of information, respectively, of the digital video signal. Similarly, the memory B 106 is constituted by memories 106_1 to 106_4 for storing a first bit to a fourth bit of information, respectively, of the digital video signal. The memories corresponding to each bit of the digital signal each have a plurality of memory elements capable of storing one bit of the signal as many as the number of pixels structuring one screen.

In general, the memory A 105 is constituted by memories 105_1 to 105_n for storing a first bit to an n-th bit of information, respectively, in a display device which is capable of expressing gradations by using an n-bits digital image signal. Similarly, the memory B 106 is constituted by memories 106_1 to 106_n for storing the first bit to the n-th bit of information, respectively. The memories corresponding to each bit of information each have a capacity that is capable of storing one bit of the signal as many as the number of pixels structuring one screen.

Figure 2:
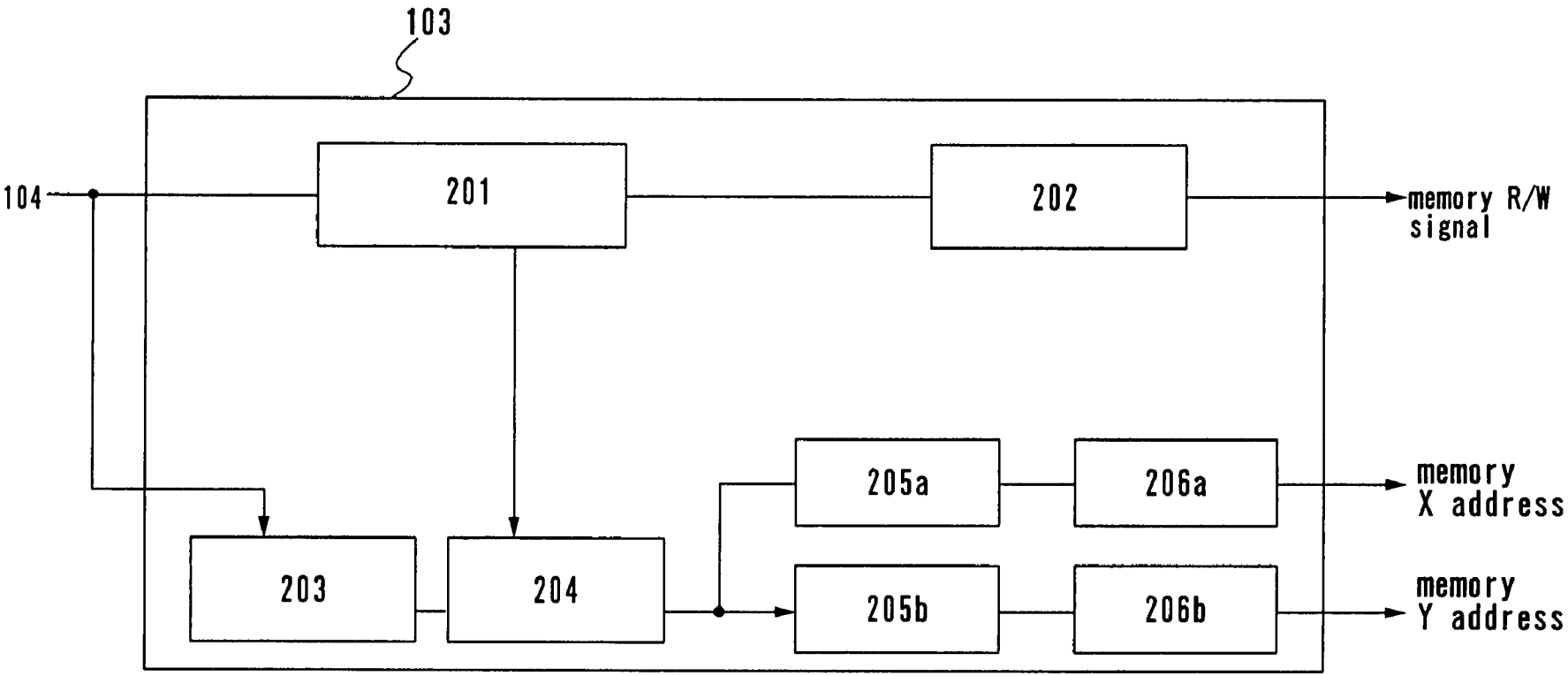
FIG. 2 is a diagram showing a structure of a memory controller of the display device of the present invention.

The structure of the memory controller 103 is shown in FIG. 2. The memory controller 103 is constituted by a gradation limiter circuit 201, a memory R/W circuit 202, a standard oscillator circuit 203, a variable frequency divider circuit 204, an x-counter 205*a*, a y-counter 205*b*, an x-decoder 206*a*, and a y-decoder 206*b* in FIG. 2.

The memory A 105 and the memory B 106 shown in FIG. 4 and FIG. 6 or the like are both taken together and denoted as memory. Furthermore, the memory is constituted by a plurality of memory elements. The memory elements are selected by using (x, y) addresses.

A signal from the CPU 104 is inputted to the memory R/W circuit 202 through the gradation limiter circuit 201. The gradation limiter circuit 201 inputs the signal to the memory R/W circuit 202 in accordance with either the first display mode or the second display mode. The memory R/W circuit 202 selects whether or not to write the digital video signal corresponding to each bit into the memory, in accordance with the signal from the gradation limiter circuit 201. Similarly, the digital image signal written into the memory is selected in readout operation.

Further, the signal from the CPU 104 is inputted to the standard oscillator circuit 203. A signal from the standard oscillator circuit 203 is inputted to the variable frequency divider circuit 204, and converted to a signal with a suitable frequency. A signal from the gradation limiter circuit 201 is inputted to the variable frequency divider circuit 204, in accordance with either the first display mode or the second display mode. Based on the inputted signal, a signal from the variable frequency divider circuit 204 selects the x-address of the memory, through the x-counter 205*a* and the x-decoder 206*a*. Similarly, a signal from the variable frequency divider circuit is inputted to the y-counter 205*b* and the y-decoder 206*b*, and selects the y-address of the memory.

The amount of information for the signal written into the memory and for the signal outputted from the memory, taken from the digital video signal inputted to the signal control circuit, can be controlled by using memory controller 103 with the above structure in the case where high-level gradation display is not necessary. Further, the frequency for reading out the signal from the memory can be changed.

Hereinafter, the structure of the display controller 102 is explained.

FIG. 3 is a diagram showing the structure of the display controller of the present invention. The display controller 102 is constituted by a standard clock generator circuit 301, a variable frequency divider circuit 302, a horizontal clock generator circuit 303, a vertical clock generator circuit 304, a power source control circuit for the light emitting element 305, and a power source control circuit for the driver circuit 306.

A clock signal 31 inputted from the CPU 104 is inputted to the standard clock generator circuit 301, and a standard clock is generated. The standard clock is inputted to the horizontal clock generator circuit 303 and to the vertical clock generator circuit 304, through the variable frequency divider circuit 302. A gradation control signal 34 is inputted to the variable frequency divider circuit 302. The frequency of the standard clock is changed in accordance with the gradation control signal 34.

The extent that the frequency of the standard clock is changed in the variable frequency divider circuit 302 can be suitably determined by the practitioner.

Furthermore, a horizontal period signal 32 which determines a horizontal period is inputted to the horizontal clock generator circuit 303 from the CPU 104, and a clock pulse S_CLK and a start pulse S_SP for the source signal line driver circuit are outputted from the horizontal clock generator circuit 303. Similarly, a vertical period signal 33 which determines a vertical period is inputted to the vertical clock generator circuit 304 from the CPU 104, and a clock pulse G_CLK and a start pulse G_SP for the gate signal line driver circuit are outputted from the vertical clock generator circuit 304.

Readout of the lower order bits of the signal from the memory is thus eliminated in the memory controller of the signal control circuit, and the frequency for reading out signals from the memory is made smaller. Corresponding to these operations, the display controller lowers the frequency of the sampling pulse SP and the frequency of the clock pulse CLK inputted to each of the driver circuits (source signal line driver circuit and gate signal line driver circuit), and lengthens the write-in period and the display period of the subframe period for expressing the image.

For example, one frame period is divided into four subframe periods in the first display mode. With the ratio of the display periods Ts1, Ts2, Ts3, and Ts4 of the respective subframe periods set to be $2^0:2^{-1}:2^{-2}:2^{-3}$, considered is a display device for expressing $2^4$ gradations using a 4-bit digital image signal. For simplicity, the lengths of the display periods Ts1 to Ts4 of each subframe period are taken to be 8, 4, 2, and 1, respectively. Further, the lengths of the write-in periods Ta1 to Ta4 of each subframe period are taken to be 1. Furthermore, a case of expressing gradations using the high 1-bit signal in the second display mode is considered.

The occupied proportion per one frame period by the subframe period in the first display mode, that corresponds to the bit participating in gradation expression in the second display mode, becomes 9/19.

Figure 9:
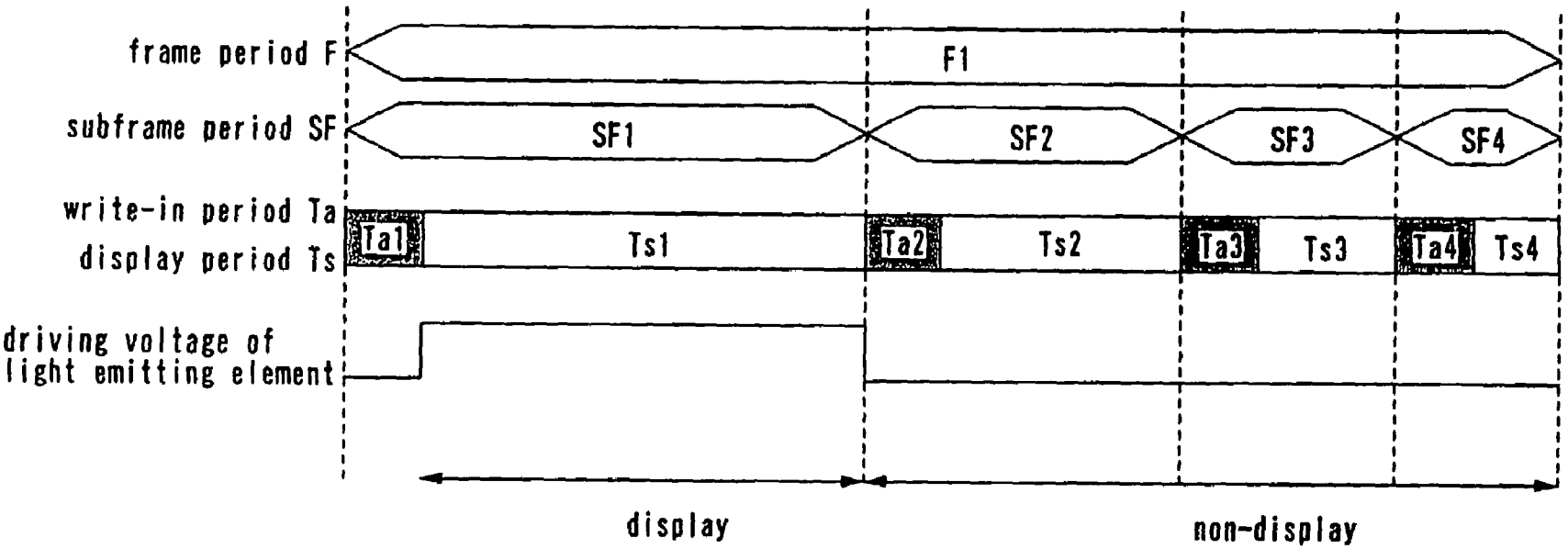
Fig. 9 Prior Art
FIG. 9 is a diagram showing a timing chart for a conventional method of driving a display device.

When the structure of the present invention is not used, for example, as a case of using the conventional driving method shown in FIG. 9, 10/19 of one frame period becomes the period which does not participate in display in the second display mode.

On the other hand, in accordance with the structure of the present invention, the frequency of the clock signal or the like inputted to each driver circuit of the display is changed in the second display mode, and the write-in period is set to be 19/9 times as long as the write-in period in the first display mode. Similarly, the display period is also set to be 19/9 times as long as the display period Ts1 of the subframe period SF1 which corresponds to the high 1-bit in the first display mode. Accordingly, the subframe period SF1 can be made to occupy one frame period. The periods which do not participate in display during one frame period can thus be reduced in the second display mode.

In this manner, the display period per one frame period of the light emitting element can also be made increased in the second display mode.

Incidentally, although one frame period is divided into four subframe periods in the first display mode to express $2^4$ gradations by using a 4-bits digital image signal in this embodiment, the present invention can also be applied to a case in which one subframe period is divided further into a plurality of subframe periods, for example, to a case in which one frame period can be divided into 6 subframe periods.

During the write-in period, the power source control circuit for the light emitting element 305 maintains the potential of the opposing electrode (opposing potential) of the light emitting element at a potential which is nearly the same as the power source potential. In the display period, the potential of the opposing electrode is controlled so as to have a potential difference from the power source potential to an extent that the light emitting element will emit light. The gradation control signal 34 is also inputted to the power source control circuit for the light emitting element 305 here. The potential of the opposing electrode of the light emitting element is thus changed in order that the voltage applied between both the electrodes of the light emitting element becomes smaller by an amount that the light emitting period for the light emitting element becomes longer.

The voltage applied between both the electrodes of the light emitting element can be made smaller in the second display mode, and therefore stress on the light emitting element due to the applied voltage can also be made smaller.

The power source control circuit for the driver circuit 306 controls the power source voltage inputted to each of the driver circuits. The gradation control signal 34 is also inputted to the power source control circuit for the driver circuit 306 here, and therefore the outputted power source voltage used for the driver circuit is changed. Since the frequency of the clock pulses of each driver circuit is smaller in the second display mode as compared to in the first display mode, each driving voltage can be operated at a lower power source voltage.

Note that the power source control circuit for the driver circuit 306 with known structures, such as the structure described in Japanese Patent Application No. 3110257, can be used.

Further, the display device may have a means for lowering the voltage used for driving the display controller, in order that the electric power consumption of the display controller can be made smaller when operating the display device in the second display mode.

The above-mentioned signal control circuit 101, memory controller 103, CPU 104, memories 105 and 106, and display controller 102 may be integrally formed on the same substrate with the display 100, or may formed by LSI chips and then be attached to the display 100 by COGS, or may be attached to the substrate by using TABs, or even, may be formed on another substrate different from that of the display and connected thereafter to the display by using electric wirings.

Embodiment 2

This embodiment shows an example of a structure of a source signal line driver circuit of a display device according to the present invention. An example of structure for the source signal line driver circuit is described with reference to FIG. 15.

Figure 15:
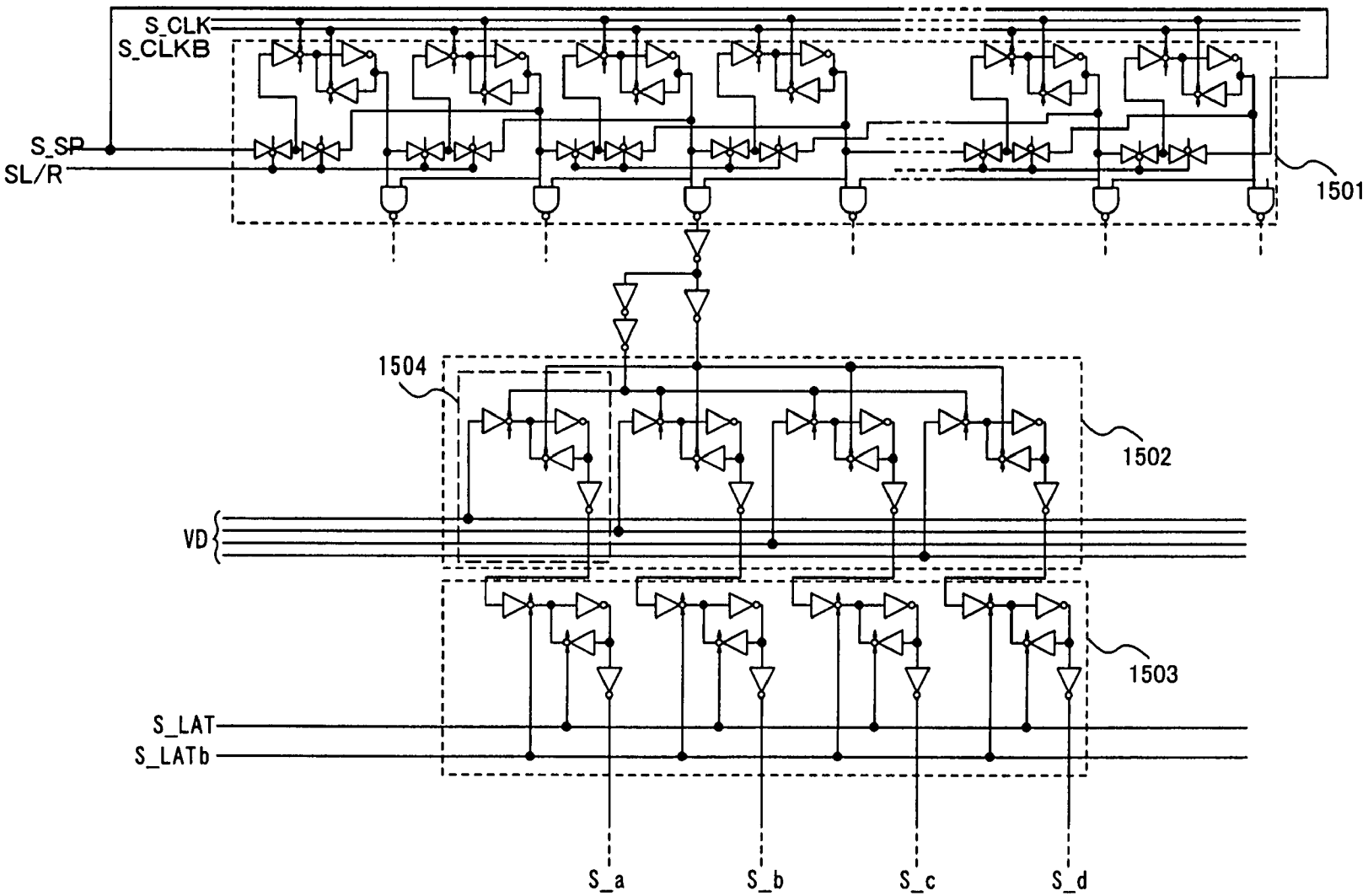
FIG. 15 is a diagram showing a structure of a source signal line driver circuit of the display device of the present invention.

The source signal line driver circuit is constituted by a shift register 1501, a scanning direction switching circuit, an LAT (A) 1502 and an LAT (B) 1503. Note that, although only a part of the LAT (A) 1502 and a part of the LAT (B) 1503 which correspond to one of the outputs from the shift register 1501 are shown in FIG. 15, the LAT (A) 1502 and the LAT (B) 1503 correspond to all of the outputs from the shift register 1501 using a similar structure.

The shift register 1501 is constituted by clocked inverters, an inverter, and a NAND. A start pulse S_SP for the source signal line driver circuit is inputted to the shift register 1501. By changing the state of the clocked inverters between a conductive state and a non-conductive state in accordance with a clock pulse S_CLK for the source signal line driver circuit and an inverted clock pulse S_CLKB for the source signal line driver circuit which has an inverse polarity to that of the clock pulse S_CLK, sampling pulses are outputted in order from the NAND to the LAT (A) 1502.

Further, the scanning direction switching circuit is constituted by switches, which works to switch the scanning direction of the shift register 1501 between left and right directions. In FIG. 15, the shift register 1501 outputs sampling pulses in order from the left to the right in the case in which a left and right switching signal L/R corresponds to a Lo signal. On the other hand, when the left and right switching signal L/R corresponds to a Hi signal, sampling pulses are outputted in order from the right to the left.

Each stage of the LAT (A) 1502 is constituted by clocked inverters and inverters.

The term "each stage of the LAT (A) 1502" denotes the LAT (A) 1502 for taking in an image signal inputted to one source signal line here.

A digital image signal VD outputted from the signal control circuit explained in the embodiment mode is inputted in p divisions (where p is a natural number) here. That is, signals corresponding to the output to p source signal lines are inputted in parallel. When a sampling pulse is inputted at the same time to the clocked inverters of p stages of the LAT (A) 1502 through buffers, then the respective input signals in p divisions are sampled simultaneously in p stages of the LAT (A) 1502.

A source signal line driver circuit for outputting signal voltages to x source signal lines is explained here, and therefore x/p sampling pulses are outputted in order from the shift register per one horizontal period. The p stages of the LAT (A) 1502 simultaneously sample the digital image signals which correspond to the output to the p source signal lines in accordance with each sampling pulse.

A method, in which the digital image signals thus inputted to the source signal line driver circuit are divided into parallel signals of p phases and the p digital image signals are simultaneously taken in by using one sampling pulse, is referred to as p-division drive in this specification. A 4-division is conducted in FIG. 15.

A margin can be given to the sampling of the shift register in the source signal line driver circuit by performing the above-stated division drive. The reliability of the display device can thus be increased.

When all of the signals for one horizontal period are inputted to each stage of the LAT (A) 1502, a latch pulse LP and an inverted latch pulse LSB which has a inverse polarity to the latch pulse LP are inputted, and the signals inputted to each stage of the LAT (A) 1502 are all outputted simultaneously to each stage of the LAT (B) 1503.

Note that the term "each stage of the LAT (B) 1503" used here denotes an LAT (B) circuit 1503 to which the signal from each stage of the LAT (A) 1502 is inputted.

Each stage of the LAT (B) 1503 is constituted by clocked inverters and inverters. The signals outputted from each stage of the LAT (A) 1502 are stored in the LAT (B) 1503 and at the same time are outputted to each of source signal lines S1 to Sx.

Note that, although not shown in the figures, circuits such as level shifters and buffers may also be suitably formed.

Signals such as the start pulse S_SP and the clock pulse S_CLK, inputted to the shift register 1501, the LAT (A) 1502, and the LAT (B) 1503, are inputted from the display controller shown in the embodiment mode 1 of the present invention.

With the present invention, operations for inputting a digital image signal with a small number of bits to the LAT (A) of the source signal line driver circuit are performed by the signal control circuit. At the same time, operations for reducing the frequency of the clock pulse S_CLK, the start pulse S_SP, and the like, inputted to the shift register of the source signal line driver circuit, and for lowering the driving voltage which drives the source signal line driver circuit, are performed by the display controller.

Operations for sampling the digital image signal by the source signal line driver circuit can thus be reduced in the second display mode, and the electric power consumption of the display device can be curbed.

Note that the source signal line driver circuit of the display device according to the present invention is not limited to the structure of the source signal line driver circuit of Embodiment 2, and that source signal line driver circuits with known structures can also be freely used.

Furthermore, the number of signal lines inputted to the source signal line driver circuit from the display controller and the number of power source lines of the driving voltage are different in accordance with the structure of the source signal line driver circuit.

This embodiment can be implemented in free combination with Embodiment 1.

Embodiment 3

An example of a structure of a gate signal line driver circuit of a display device according to the present invention will be explained in Embodiment 3.

The gate signal line driver circuit is constituted by a shift register, a scanning direction switching circuit, and the like. Note that, although not shown in the figure, circuits such as level shifters and buffers may also be suitably formed.

Signals such as a start pulse G_SP and a clock pulse G_CLK, and driving voltages or the like are inputted to the shift register, and a gate signal line selection signal is outputted.

Figure 16:
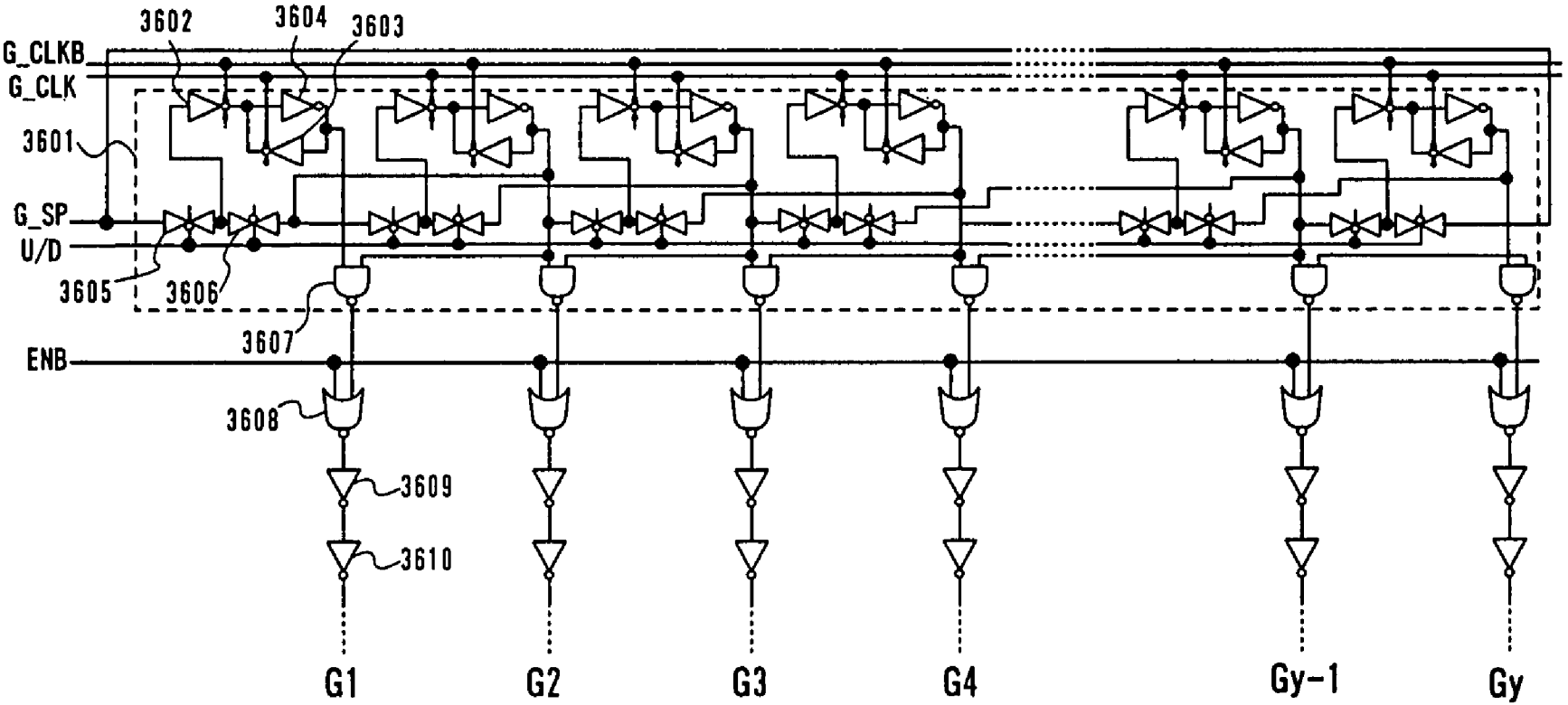
FIG. 16 is a diagram showing a structure of a gate signal line driver circuit of the display device of the present invention.
Figure 17:
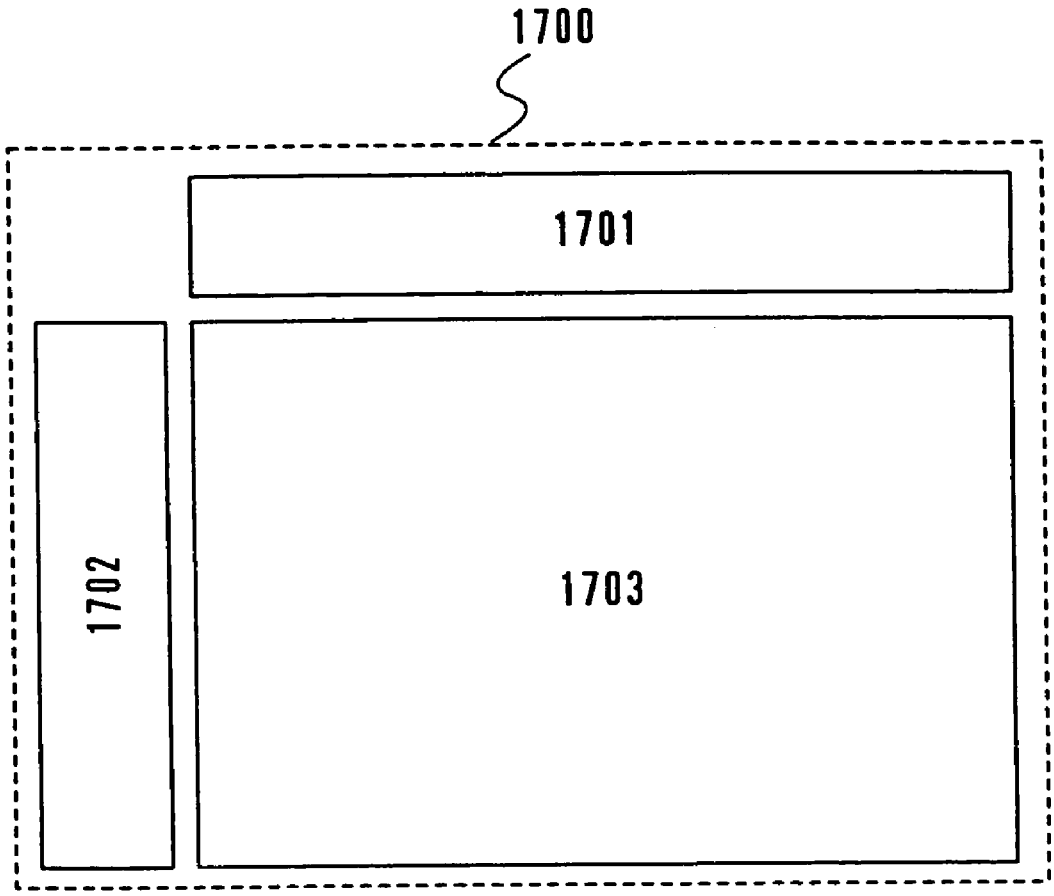
Fig. 17 Prior Art
FIG. 17 is a block diagram showing a structure of the conventional display.

The structure of the gate signal line driver circuit is explained with reference to FIG. 16. A shift register 3601 is constituted by clocked inverters 3602 and 3603, an inverter 3604, and a NAND 3607. The start pulse G_SP is inputted to the shift register 3601. By changing the state of the clocked inverters 3602 and 3603 between a conductive state and a non-conductive state in accordance with a clock pulse G_CLK and an inverted clock pulse G_CLKB which has a inverse polarity to the clock pulse G_CLK, sampling pulses are outputted in order from the NAND 3607.

Furthermore, the scanning direction switching circuit is constituted by switches 3605 and 3606, and functions to switch the scanning direction of the shift register between left and right directions. In FIG. 16, the shift register outputs sampling pulses in order from the left to the right in the case where a scanning direction switching signal U/D corresponds to a Lo signal. On the other hand, when the scanning direction switching signal U/D corresponds to a Hi signal, sampling pulses are outputted in order from the right to the left.

The sampling pulses outputted from the shift register are inputted to a NOR 3608, and operation is performed with an enable signal ENB. This operation is performed in order to prevent a condition where adjacent gate signal lines are selected at the same time due to dull sampling pulses. The signals outputted from the NOR 3608 are outputted to gate signal lines G1 to Gy, through buffers 3609 and 3610.

Note that, although not shown in the figure, circuits such as level shifters and buffers may also be appropriately formed.

Signals such as the start pulse G_SP and the clock pulse G_CLK, and the driving voltages or the like inputted to the shift register are inputted from a display controller shown in Embodiment mode 1.

With the present invention, operations to reduce the frequency of the clock pulse G_CLK, the start pulse G_SP or the like inputted to the shift register of the gate signal line driver circuit, and operations to lower the driving voltage used for operating the gate signal line driver circuit are performed by the display controller in the second display mode.

In this manner, sampling operations of the gate signal line driver circuit can be reduced, and the electric power consumption of the display device can thus be controlled in the second display mode.

Incidentally, the gate signal line driver circuit of the display device according to the present invention is not limited to the structure of the gate signal line driver circuit of Embodiment 3. Gate signal line driver circuits with known structures can be freely used.

Furthermore, the number of signal lines inputted to the gate signal line driver circuit from the display controller, and the number of power source lines of the driving voltage are different in accordance with the structure of the gate signal line driver circuit.

This embodiment can be implemented in free combination with Embodiments 1 and 2.

Embodiment 4

Figure 8:
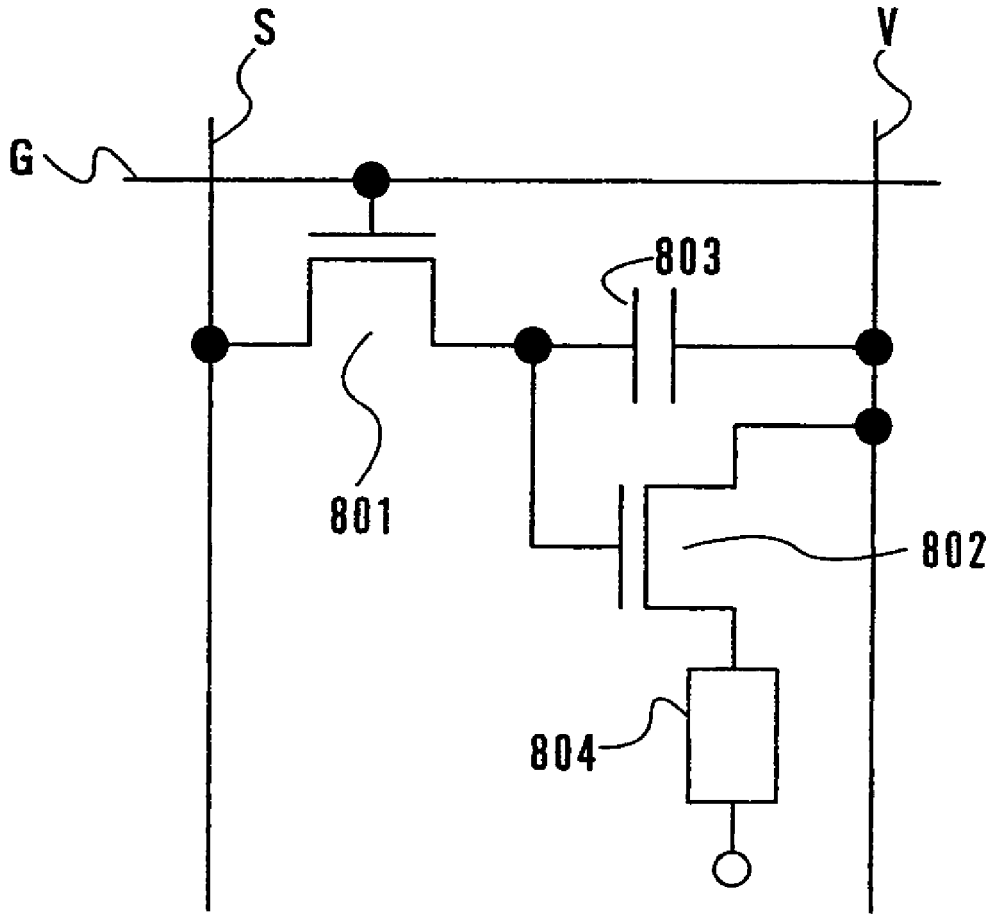
FIG. 8 is a diagram showing a structure of a pixel of the display device.

In the display device using the time gradation, in addition to a method of separating an address period from a display period, which is described above, a driving method of simultaneously conducting writing and display has been proposed. Specifically, a display device using a pixel configuration as shown in FIG. 8 is disclosed in Japanese Patent Application No. 2001-343933. According to this method, in addition to a conventional switching TFT and a conventional driving TFT, an erasing TFT can be added to increase the number of gradations.

Specifically, a plurality of gate signal line driver circuits are provided, writing is conducted by a first gate signal line driver circuit, and erasing is conducted in a second gate signal line driver circuit before writing is completed for all lines. In the case of 4 bits, there are not much effects. However, in the case where the gradation becomes 6 bits or more or in the case where it is necessary to increase the number of subframes for a pseudo contour measure, this is a very effective measure. The present invention can also be applied to a display device using such a driving method.

Figure 10A:
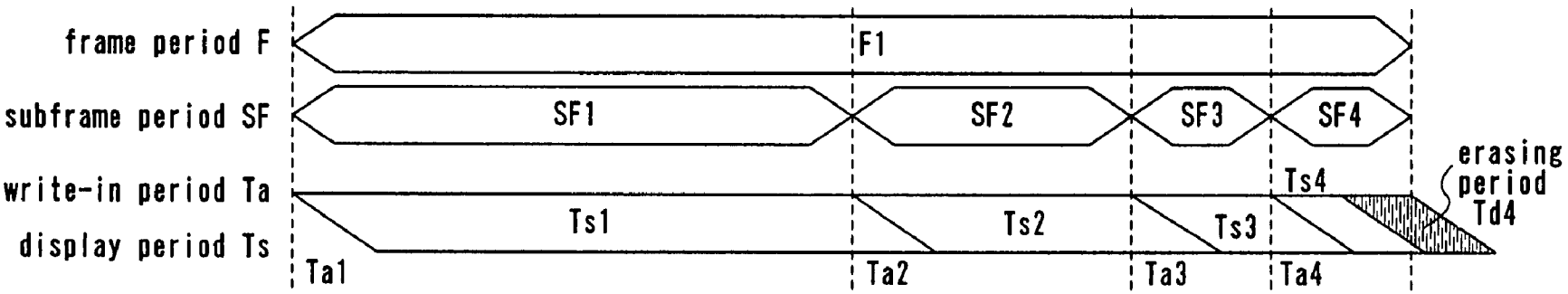
FIGS. 10A and 10B are diagrams showing timing charts for a method of driving the display device of the present invention.

FIG. 10A is a timing chart in the case of displaying in a first display mode. In FIG. 10A, a display period is shortened by erasing in a second gate signal line driver circuit at a fourth bit.

Figure 10B:
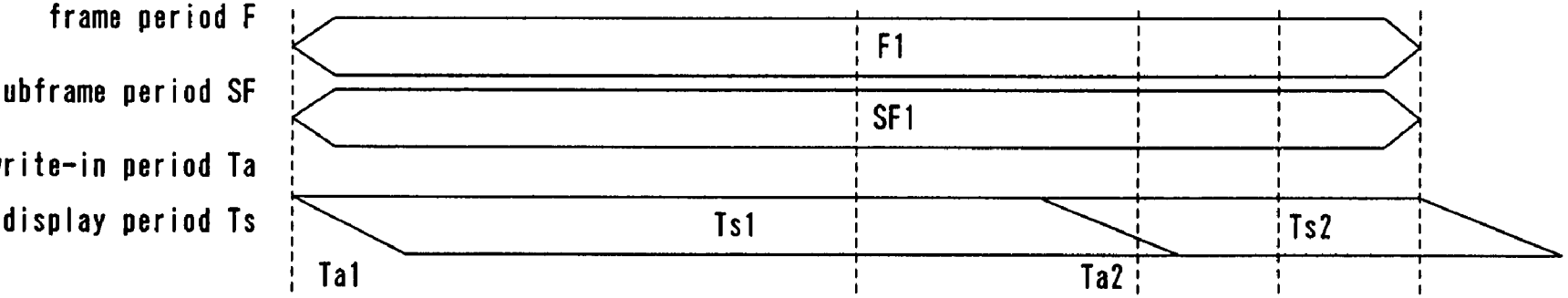

FIG. 10B is a timing chart in the case of displaying in a second display mode. There is no need to erase in a second gate signal line driver circuit, so it is not necessary to input the start pulse G_SP and the clock pulse G_CLK to the second gate signal line driver circuit.

This embodiment can be freely combined with Embodiments 1 to 3.

Embodiment 5

Figure 11A:
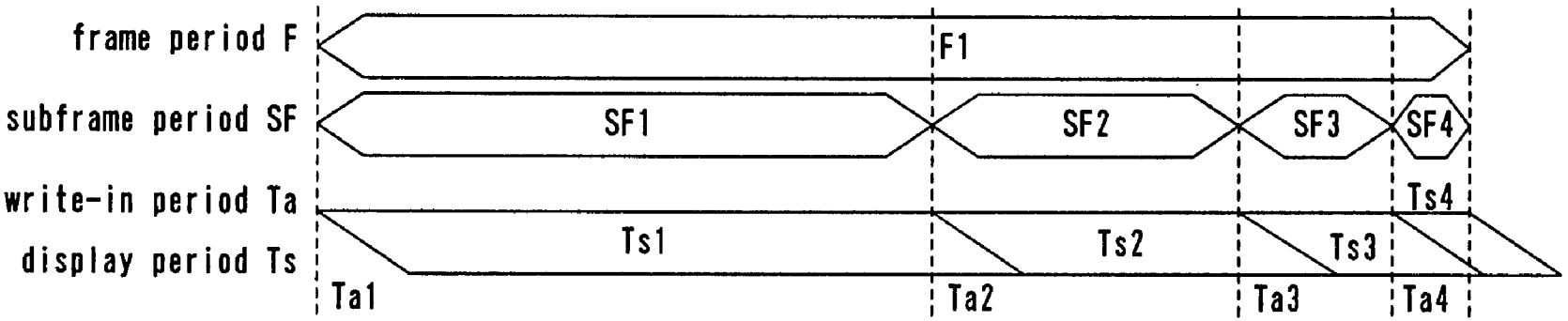
FIGS. 11A and 11B are diagrams showing timing charts for a method of driving the display device of the present invention.
Figure 11B:
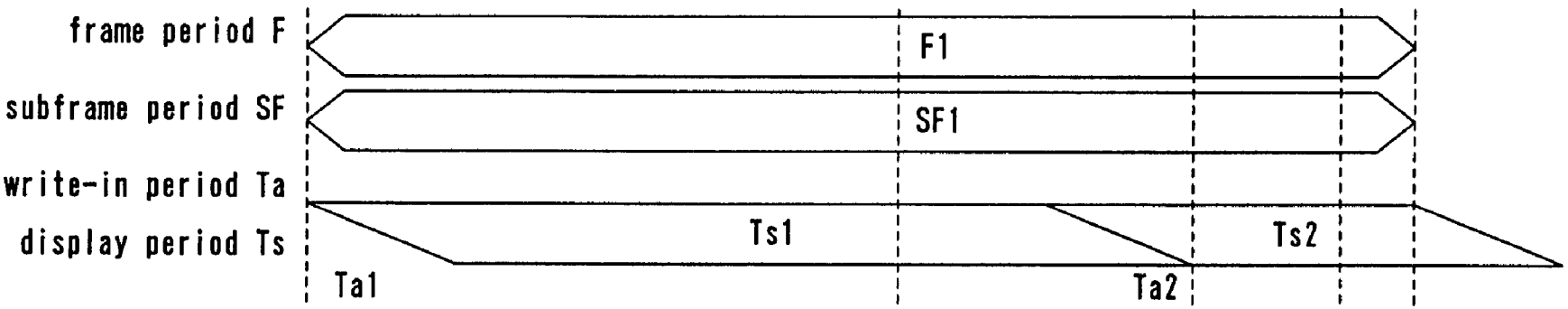

A method in which the number of gradations capable of displaying is small but an address period and a display period are simultaneously conducted as in Embodiment 4 has also been proposed. Timing charts in this case for the first display mode and the second display mode are shown in FIGS. 11A and 11B, respectively. A pixel configuration in this case is the same as a conventional configuration as shown in FIG. 8. There is no erasing period and a display period shorter than an address period cannot be constructed. Thus, there is a defect in that the number of gradations in a first display mode is small. However, because a circuit configuration can be simplified, it can be applied to an inexpensive edition display device. This embodiment can be freely combined with Embodiments 1 to 3. Note that although the frame period of this embodiment is divided in the second display mode, the present invention can also be applied to the structure in which the frame period is not divided.

Embodiment 6

Figure 12:
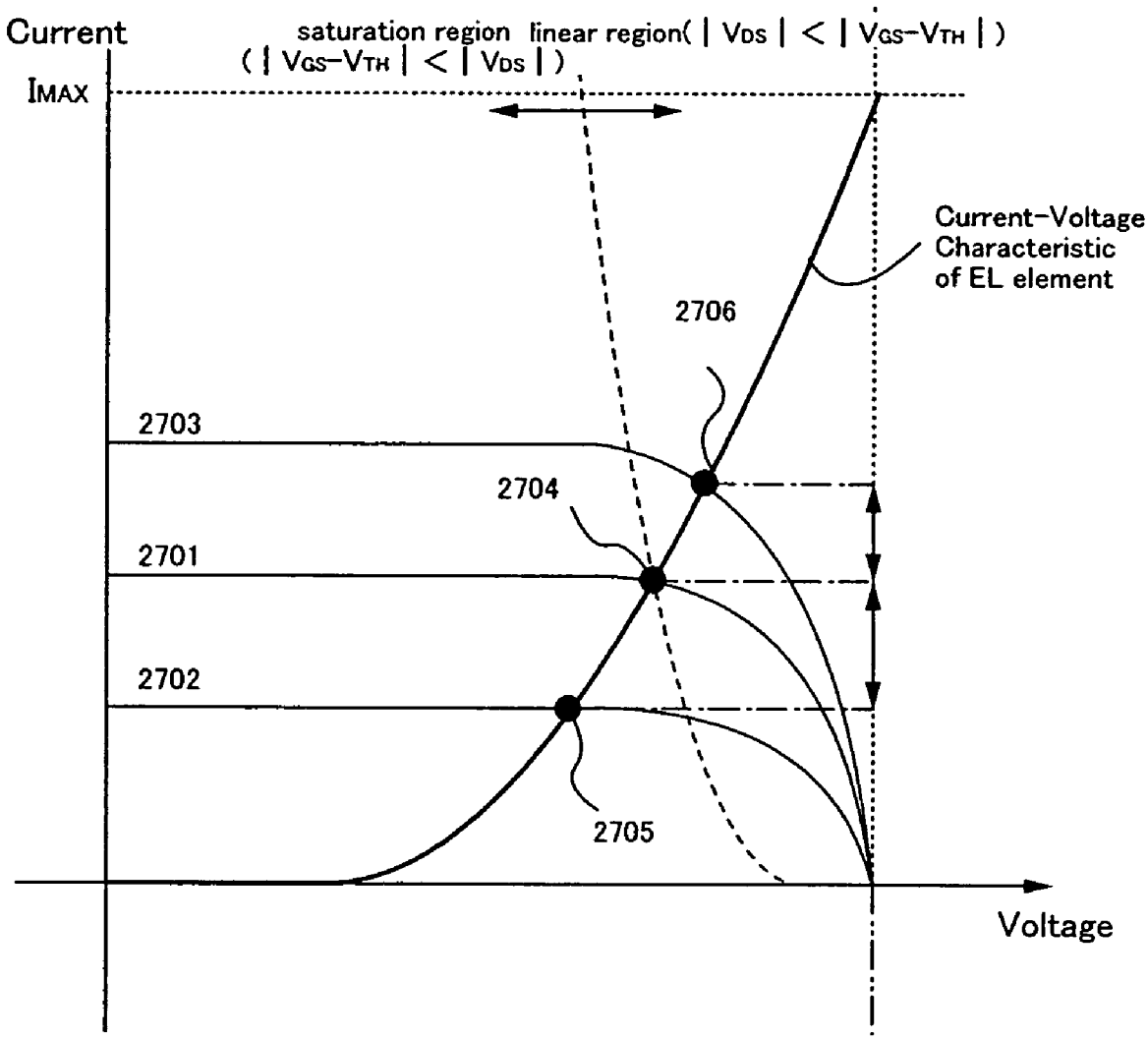
FIG. 12 is a diagram showing an operating condition of a driver TFT of the present invention.
Figure 13A:
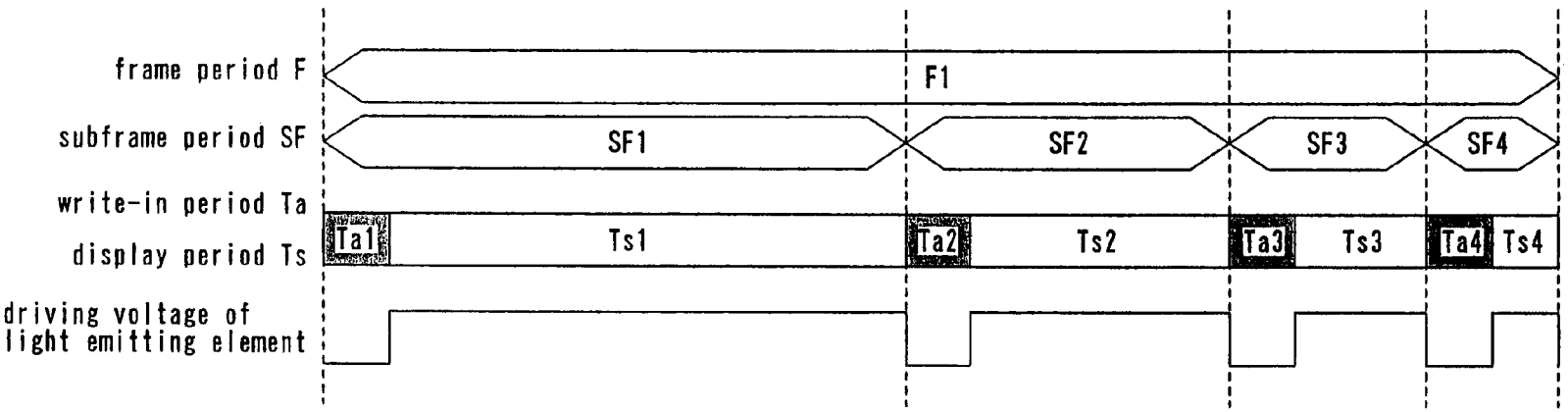
Prior Art Fig. 13A
FIGS. 13A and 13B are diagrams showing timing charts for the conventional method of driving a display device.
Figure 13B:
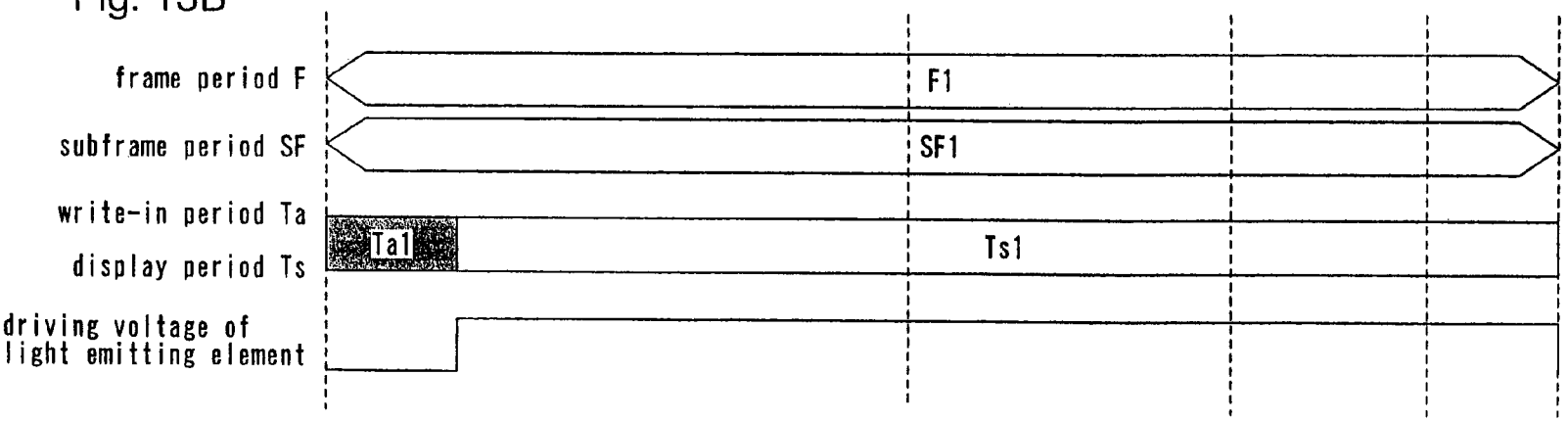

According to the above method, time gradation operation is conducted by constant voltage drive. In other words, a driving TFT in a pixel is operated in a linear region. Thus, an external power source voltage is applied to a light emitting element as it is. However, there is a following defect in this method. When the light emitting element is deteriorated to change a characteristic between an applied voltage and brightness, a image persistence is caused so that display quality is deteriorated. Therefore, there is a driving method of conducting constant current drive, that is, operating a driving TFT in a pixel in a saturation region, thereby using the driving TFT as a current source. Even in this case, when an operating period of the driving TFT is controlled, time gradation is possible. This is described in Japanese Patent Application No. 2001-224422. The present invention can be applied to such constant current time gradation. FIG. 12 shows an operating point of the driving TFT. When the constant current drive is conducted, the TFT is operated in a saturation region in which an operating point 2705 is present. When the constant voltage drive is conducted, the TFT is operated in a linear region in which an operating point 2706 is present.

This embodiment can be implemented in free combination with Embodiments 1 to 5.

Embodiment 7

The explanation throughout this specification uses, as the light emitting elements, elements (OLED elements) having a structure in which an organic compound layer, that emits light when an electric field is generated is sandwiched between an anode and a cathode, but the light emitting elements of the present invention is not limited to this structure.

Further, the explanation within this specification uses elements that utilize light emitted when making a transition from singlet excitons to a base state (fluorescence), and those that utilize light emitted when making a transition from triplet excitons to a base state (phosphorescence).

An organic compound layer includes a hole injection layer, a hole transporting layer, a light emitting layer, an electron transporting layer, an electron injection layer, and the like. The basic structure of a light emitting element is a laminate of an anode, a light emitting layer, and a cathode layered in this order. The basic structure can be modified into a laminate of an anode, a hole injection layer, a light emitting layer, an electron injection layer, and a cathode layered in this order, or a laminate of an anode, a hole injection layer, a hole transporting layer, a light emitting layer, an electron transporting layer, an electron injection layer, and a cathode layered in this order.

It should be noted that the organic compound layer is not limited to an organic compound layer having the laminated structure in which a hole injection layer, a hole transportation layer, a light emitting layer, an electron transporting layer, an electron injection layer or the like is clearly discriminated. Specifically, the organic compound layer may be of a structure having a mixed layer in which materials constituting the hole injection layer, the hole transportation layer, the light emitting layer, the electron transportation layer, the electron injection layer and the like are mixed.

Furthermore, an inorganic material may be mixed in the organic compound layer.

Further, any one of a low molecular material, a high molecular material, and an intermediate molecular material can be a material for an organic compound layer of OLED elements.

Note that an intermediate molecular material in this specification denotes a material without sublimeness, in which the number of molecules is 20 or less, or the length of a chain of its molecular is 10 ìm or less.

This embodiment can be implemented in free combination with Embodiments 1 to 6.

Embodiment 8

This embodiment describes electronic equipment which uses the display device of the present invention, with reference to FIGS. 14A to 14F.

Figure 14A:
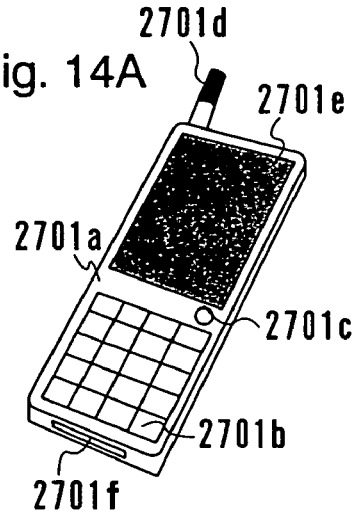
FIGS. 14A to 14F are diagrams showing electronic equipment of the present invention.

FIG. 14A is a schematic diagram of a portable information terminal using the display device of the present invention. The portable information terminal is composed of a main body 2701*a*, operating switches 2701*b*, a power source switch 2701*c*, an antenna 2701*d*, a display portion 2701*e*, and an external input port 2701*f*. The display device of the present invention can be used in the display portion 2701*e*.

Figure 14B:
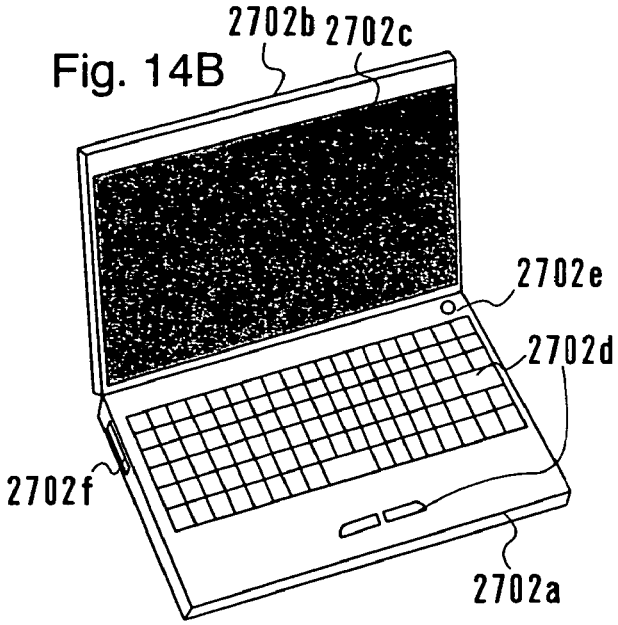

FIG. 14B is a schematic diagram of a personal computer using the display device of the present invention. The personal computer is composed of a main body 2702*a*, a housing 2702*b*, a display portion 2702*c*, operation switches 2702*d*, a power switch 2702*e*, and an external input port 2702*f*. The display device of the present invention can be used in the display portion 2702*c*.

Figure 14C:
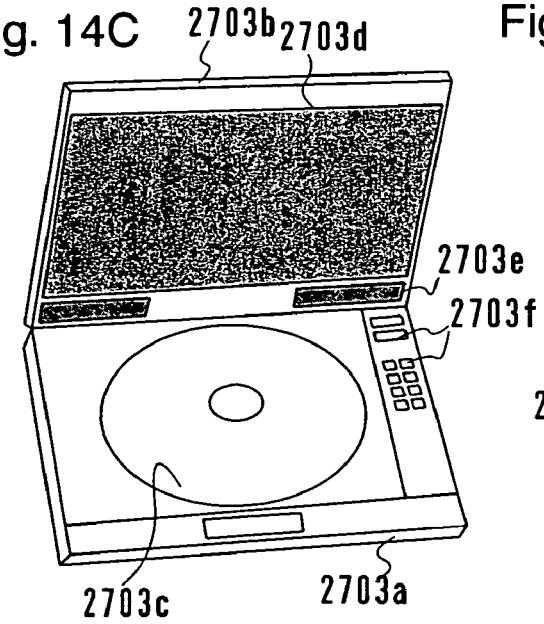

FIG. 14C is a schematic diagram of an image reproducing device using the display device of the present invention. The image reproducing device is composed of a main body 2703*a*, a housing 2703*b*, a recording medium 2703*c*, a display portion 2703*d*, an audio output portion 2703*e*, and operation switches 2703*f*. The display device of the present invention can be used in the display portion 2703*d*.

Figure 14D:
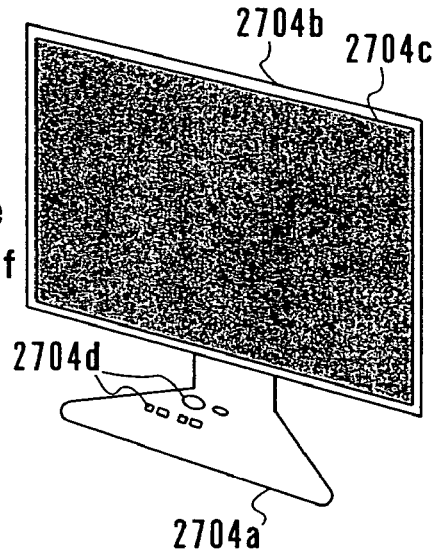

FIG. 14D is a schematic diagram of a television using the display device of the present invention. The television is composed of a main body 2704*a*, a housing 2704*b*, a display portion 2704*c*, and operation switches 2704*d*. The display device of the present invention can be used in the display portion 2704*c*.

Figure 14E:
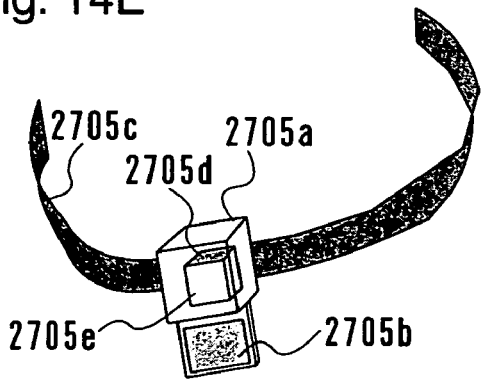

FIG. 14E is a schematic diagram of a head mounted display using the display device of the present invention. The head mounted display is composed of a main body 2705*a*, a monitor portion 2705*b*, a headband 2705*c*, a display portion 2705*d*, and an optical system 2705*e*. The display device of the present invention can be used in the display portion 2705*d*.

Figure 14F:
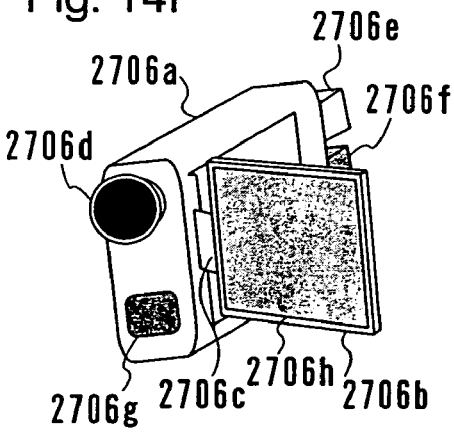

FIG. 14F is a schematic diagram of a video camera using the display device of the present invention. The video camera is composed of a main body 2706*a*, a housing 2706*b*, a connection portion 2706*c*, an image receiving portion 2706*d*, an eye piece portion 2706*e*, a battery 2706*f*, an audio input portion 2706*g*, and a display portion 2706*h*. The display device of the present invention can be used in the display portion 2706*h*.

No limitation is put on the above-mentioned applications of electronic equipment, the present invention can be applied to various electronic equipment.

This embodiment can be implemented in free combination with Embodiments 1 to 7.

The electric power consumption of a display device can be reduced with the aforementioned structures of the present invention. In addition, it becomes possible to lengthen the display period in one frame period, even in the case of reducing the number of subframes used for expressing gradations in the second display mode. Accordingly, it becomes possible to provide a display device which is capable of displaying clear images, and provide also a driving method of the same.

Furthermore, since the display period for a light emitting element in one frame period can be increased, the voltage applied between an anode and a cathode of the light emitting element can be set lower in the case of expressing the same brightness in one frame. It thus becomes possible to provide a display device with high reliability.

It is also possible to apply the present invention not only to a display device using OLED elements as light emitting elements, but also to self-light emitting type display devices such as field emission displays and plasma displays.

What is claimed is:

1. A display device comprising:

a display including a source signal line driver circuit and a gate signal line driver circuit;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means not for dividing one frame period into a plurality of subframe periods, for setting one of lighting and non-lighting to the one frame period, and for expressing 1-bit gradation in accordance with a total lighting time during the one frame period, wherein the display and the display controller are formed over a common substrate, wherein the second means has a lower voltage for driving the source signal line driver circuit and the gate signal line driver circuit than the first means, and wherein the first and second means are controlled by the display controller.

2. A display device according to claim 1, wherein the display device further comprises a frame memory;

n-bits data (n is a natural number of two or more) is written and read out to perform a display operation in the first means; and 1-bit data is written and read out to perform a display operation in the second means.

3. A display device according to claim 1, wherein the display device further comprises a light emitting element for each pixel;

a specific voltage is applied to the light emitting element; and a voltage applied to the light emitting element in the first means is higher than a voltage applied to the light emitting element in the second means.

4. A display device according to claim 1, wherein the display device further comprises a light emitting element for each pixel;

a specific current is supplied to the light emitting element; and a current supplied to the light emitting element in the first means is larger than a current supplied to the light emitting element in the second means.

5. A display device according to claim 1, wherein the one frame period of the first means is composed of three periods of a write-in period, a display period, and an erasing period.

6. A display device according to claim 1, wherein the display controller operates at a lower voltage in the second means as compared to in the first means.

7. A display device according to claim 1, wherein the display device is used in an electronic equipment selected from the group consisting of a portable information terminal, a personal computer, an image reproducing device, a television, a head mounted display and a video camera.

8. A display device comprising:

a display including a source signal line driver circuit and a gate signal line driver circuit;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means not for dividing one frame period into a plurality of subframe periods, for setting one of lighting and non-lighting to the one frame period, and for expressing 1-bit gradation in accordance with a total lighting time during the one frame period, wherein the display and the display controller are formed over a common substrate, wherein the second means has a longer frame period as compared to the one frame period for expressing n-bits gradation, wherein the second means has a lower voltage for driving the source signal line driver circuit and the gate signal line driver circuit than the first means, and wherein the first and second means are controlled by the display controller.

9. A display device according to claim 8, wherein the display device further comprises a frame memory;

n-bits data (n is a natural number of two or more) is written and read out to perform a display operation in the first means; and 1-bit data is written and read out to perform a display operation in the second means.

10. A display device according to claim 8, wherein the display device further comprises a light emitting element for each pixel;

a specific voltage is applied to the light emitting element; and a voltage applied to the light emitting element in the first means is higher than a voltage applied to the light emitting element in the second means.

11. A display device according to claim 8, wherein the display device further comprises a light emitting element for each pixel;

a specific current is supplied to the light emitting element; and a current supplied to the light emitting element in the first means is larger than a current supplied to the light emitting element in the second means.

12. A display device according to claim 8, wherein the one frame period of the first means is composed of three periods of a write-in period, a display period, and an erasing period.

13. A display device according to claim 8, wherein the display controller operates at a lower voltage in the second means as compared to in the first means.

14. A display device according to claim 8, wherein the display device is used in an electronic equipment selected from the group consisting of a portable information terminal, a personal computer, an image reproducing device, a television, a head mounted display and a video camera.

15. A display device comprising:

a display including a source signal line driver circuit and a gate signal line driver circuit;

a display controller;

a first means for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second means for dividing one frame period into a plurality of subframe periods, for setting one of lighting and non-lighting to each of the plurality of subframe periods, and for expressing m-bit gradation (m is a natural number less than n) in accordance with a total lighting time during the one frame period, wherein the display and the display controller are formed over a common substrate, wherein the second means has a lower voltage for driving the source signal line driver circuit and the gate signal line driver circuit than the first means, and wherein the first and second means are controlled by the display controller.

16. A display device according to claim 15, wherein the display device further comprises a frame memory;

n-bits data (n is a natural number of two or more) is written and read out to perform a display operation in the first means; and m-bit data (m is a natural number less than n) is written and read out to perform a display operation in the second means.

17. A display device according to claim 15, wherein the display device further comprises a light emitting element for each pixel;

a specific voltage is applied to the light emitting element; and a voltage applied to the light emitting element in the first means is higher than a voltage applied to the light emitting element in the second means.

18. A display device according to claim 15, wherein the display device further comprises a light emitting element for each pixel;

a specific current is supplied to the light emitting element; and a current supplied to the light emitting element in the first means is larger than a current supplied to the light emitting element in the second means.

19. A display device according to claim 15, wherein the one frame period of the first means is composed of three periods of a write-in period, a display period, and an erasing period.

20. A display device according to claim 15, wherein the display controller operates at a lower voltage in the second means as compared to in the first means.

21. A display device according to claim 15, wherein the display device is used in an electronic equipment selected from the group consisting of a portable information terminal, a personal computer, an image reproducing device, a television, a head mounted display and a video camera.

22. A method of driving a display device having a display including a source signal line driver circuit and a gate signal line driver circuit and a display controller, comprising:

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode not for dividing one frame period into a plurality of subframe periods, for setting one of lighting and non-lighting to the one frame period, and for expressing 1-bit gradation in accordance with a total lighting time during the one frame period, wherein the display and the display controller are formed over a common substrate, wherein the second display mode has a lower voltage for driving the source signal line driver circuit and the gate signal line driver circuit than the first display mode, and wherein the first and second display modes are controlled by the display controller.

23. A method of driving a display device according to claim 22, wherein the display device further comprises a frame memory;

n-bits data (n is a natural number of two or more) is written and read out to perform a display operation in the first display mode; and 1-bit data is written and read out to perform a display operation in the second display mode.

24. A method of driving a display device according to claim 22, wherein the display device further comprises a light emitting element for each pixel;

a specific voltage is applied to the light emitting element; and a voltage applied to the light emitting element in the first display mode is higher than a voltage applied to the light emitting element in the second display mode.

25. A method of driving a display device according to claim 22, wherein the display device further comprises a light emitting element for each pixel;

a specific current is supplied to the light emitting element; and a current supplied to the light emitting element in the first display mode is larger than a current supplied to the light emitting element in the second display mode.

26. A method of driving a display device according to claim 22, wherein the first display mode is composed of three periods of a write-in period, a display period, and an erasing period.

27. A method of driving a display device according to claim 22, wherein the display controller operates at a lower voltage in the second display mode as compared to in the first display mode.

28. A method of driving a display device according to claim 22, wherein the display device is used in an electronic equipment selected from the group consisting of a portable information terminal, a personal computer, an image reproducing device, a television, a head mounted display and a video camera.

29. A method of driving a display device having a display including a source signal line driver circuit and a gate signal line driver circuit and a display controller, comprising:

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode not for dividing one frame period into a plurality of subframe periods, for setting one of lighting and non-lighting to the one frame period, and for expressing 1-bit gradation in accordance with a total lighting time during the one frame period, wherein the display and the display controller are formed over a common substrate, wherein the second mode has a longer frame period as compared to the one frame period for expressing n-bits gradation, wherein the second display mode has a lower voltage for driving the source signal line driver circuit and the gate signal line driver circuit than the first display mode, and wherein the first and second display modes are controlled by the display controller.

30. A method of driving a display device according to claim 29, wherein the display device further comprises a frame memory;

n-bits data (n is a natural number of two or more) is written and read out to perform a display operation in the first display mode; and 1-bit data is written and read out to perform a display operation in the second display mode.

31. A method of driving a display device according to claim 29, wherein the display device further comprises a light emitting element for each pixel;

a specific voltage is applied to the light emitting element; and a voltage applied to the light emitting element in the first display mode is higher than a voltage applied to the light emitting element in the second display mode.

32. A method of driving a display device according to claim 29, wherein the display device further comprises a light emitting element for each pixel;

a specific current is supplied to the light emitting element; and a current supplied to the light emitting element in the first display mode is larger than a current supplied to the light emitting element in the second display mode.

33. A method of driving a display device according to claim 29, wherein the first display mode is composed of three periods of a write-in period, a display period, and an erasing period.

34. A method of driving a display device according to claim 29, wherein the display controller operates at a lower voltage in the second display mode as compared to in the first display mode.

35. A method of driving a display device according to claim 29, wherein the display device is used in an electronic equipment selected from the group consisting of a portable information terminal, a personal computer, an image reproducing device, a television, a head mounted display and a video camera.

36. A method of driving a display device having a display including a source signal line driver circuit and a gate signal line driver circuit and a display controller, comprising:

a first display mode for dividing one frame period into a plurality of subframe periods and setting one of lighting and non-lighting to each of the plurality of subframe periods, and for expressing n-bits gradation (n is a natural number of two or more) in accordance with a total lighting time during the one frame period; and a second display mode for dividing one frame period into a plurality of subframe periods and setting one of lighting and non-lighting to each of the plurality of subframe periods, and for expressing m-bit gradation (m is a natural number less than n) in accordance with a total lighting time during the one frame period, wherein the display and the display controller are formed over a common substrate, wherein the second display mode has a lower voltage for driving the source signal line driver circuit and the gate signal line driver circuit than the first display mode, and wherein the first and second display modes are controlled by the display controller.

37. A method of driving a display device according to claim 36, wherein the display device further comprises a frame memory;

n-bits data (n is a natural number of two or more) is written and read out to perform a display operation in the first display mode; and 1-bit data is written and read out to perform a display operation in the second display mode.

38. A method of driving a display device according to claim 36, wherein the display device further comprises a light emitting element for each pixel;

a specific voltage is applied to the light emitting element; and a voltage applied to the light emitting element in the first display mode is higher than a voltage applied to the light emitting element in the second display mode.

39. A method of driving a display device according to claim 36, wherein the display device further comprises a light emitting element for each pixel;

a specific current is supplied to the light emitting element; and a current supplied to the light emitting element in the first display mode is larger than a current supplied to the light emitting element in the second display mode.

40. A method of driving a display device according to claim 36, wherein the first display mode is composed of three periods of a write-in period, a display period, and an erasing period.

41. A method of driving a display device according to claim 36, wherein the display controller operates at a lower voltage in the second display mode as compared to in the first display mode.

42. A method of driving a display device according to claim 36, wherein the display device is used in an electronic equipment selected from the group consisting of a portable information terminal, a personal computer, an image reproducing device, a television, a head mounted display and a video camera.

* * * * *